US011253900B2

(12) United States Patent
Nogiwa et al.

(10) Patent No.: US 11,253,900 B2
(45) Date of Patent: Feb. 22, 2022

(54) FORMING APPARATUS

(71) Applicant: SUMITOMO HEAVY INDUSTRIES, LTD., Tokyo (JP)

(72) Inventors: Kimihiro Nogiwa, Ehime (JP); Masayuki Ishizuka, Ehime (JP); Masayuki Saika, Ehime (JP); Norieda Ueno, Tokyo (JP); Akihiro Ide, Ehime (JP); Hiroyuki Kan, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 168 days.

(21) Appl. No.: 16/582,551

(22) Filed: Sep. 25, 2019

(65) Prior Publication Data

US 2020/0016645 A1 Jan. 16, 2020

Related U.S. Application Data

(63) Continuation of application No. PCT/JP2018/012966, filed on Mar. 28, 2018.

(30) Foreign Application Priority Data

Mar. 30, 2017 (JP) ..... JP2017-067968

(51) Int. Cl.
*B21D 26/047* (2011.01)
*B21D 37/16* (2006.01)

(52) U.S. Cl.
CPC ..... *B21D 26/047* (2013.01); *B21D 37/16* (2013.01)

(58) Field of Classification Search
CPC .. B21D 26/041; B21D 26/043; B21D 26/047; B21D 26/033; B21D 37/16
See application file for complete search history.

(56) References Cited

U.S. PATENT DOCUMENTS 5,107,693 A * 4/1992 Olszewski ..... B21D 26/041 29/421.1
10,040,110 B2 8/2018 Ishizuka et al.
(Continued)

FOREIGN PATENT DOCUMENTS

DE 898142 C 11/1953
JP 2005-324209 A 11/2005
(Continued)

OTHER PUBLICATIONS

Search Report issued in European Application No. 18774337.2, dated Feb. 13, 2020.
(Continued)

*Primary Examiner* — Teresa M Ekiert
(74) *Attorney, Agent, or Firm* — Michael Best & Friedrich LLP

(57) ABSTRACT

A forming apparatus which forms a metal pipe by expanding a metal pipe material, includes: a forming die for forming the metal pipe; a first electrode and a second electrode which clamp the metal pipe material at both end sides and heat the metal pipe material by causing an electric current to flow through the metal pipe material; and a first fluid supply unit and a second fluid supply unit which supply a fluid into the metal pipe material heated by the first electrode and the second electrode to expand the metal pipe material, wherein at least one of the first electrode and the second electrode is provided with a movement restriction mechanism which restricts a movement of the metal pipe material in an axial direction of the metal pipe material.

10 Claims, 14 Drawing Sheets

(56) References Cited

U.S. PATENT DOCUMENTS

| | | | |
|---|---|---|---|
| 2016/0279693 | A1 | 9/2016 | Ueno et al. |
| 2017/0095853 | A1 | 4/2017 | Ishizuka et al. |

FOREIGN PATENT DOCUMENTS

| | | | |
|---|---|---|---|
| JP | 2009-220141 | A | 10/2009 |
| JP | 2015-112608 | A | 6/2015 |
| JP | 2016-190252 | A | 11/2016 |
| WO | WO-2015/087601 | A1 | 6/2015 |
| WO | 2015194439 | A1 | 12/2015 |

OTHER PUBLICATIONS

International Search Report issued in Application No. PCT/JP2018/012966, dated May 15, 2018.

* cited by examiner

FORMING APPARATUS

RELATED APPLICATIONS

The contents of Japanese Patent Application No. 2017-067968, and of International Patent Application No. PCT/JP2018/012966, on the basis of each of which priority benefits are claimed in an accompanying application data sheet, are in their entirety incorporated herein by reference.

BACKGROUND

Technical Field

Certain embodiments of the present invention relate to a forming apparatus.

Description of Related Art

In the related art, a forming apparatus in which a metal pipe is closed by a forming die and blow-formed is known. For example, a forming apparatus of the related art includes a forming die, and a gas supply unit which supplies gas into a metal pipe material. In this forming apparatus, the metal pipe material is formed into a shape corresponding to the shape of the forming die by disposing a heated metal pipe material in the forming die and expanding the metal pipe material by supplying gas from the gas supply unit to the metal pipe material in a state where the forming die is closed.

SUMMARY

According to an embodiment of the present invention, there is provided a forming apparatus which forms a metal pipe, including: a forming die for forming the metal pipe; a first electrode and a second electrode which clamp the metal pipe material at both end sides and heat the metal pipe material by causing an electric current to flow through the metal pipe material; and a first fluid supply unit and a second fluid supply unit which supply a fluid into the metal pipe material heated by the first electrode and the second electrode to expand the metal pipe material, wherein at least one of the first electrode and the second electrode is provided with a movement restriction mechanism which restricts a movement of the metal pipe material in an axial direction of the metal pipe material.

BRIEF DESCRIPTION OF THE DRAWINGS

FIGS. 2A to 2C are enlarged views of the surroundings of an electrode, in which FIG. 2A is a diagram showing a state where the electrode holds a metal pipe material, FIG. 2B is a diagram showing a state where a seal member is pressed against the electrode, and FIG. 2C is a front view of the electrode.

DETAILED DESCRIPTION

Figure 1:
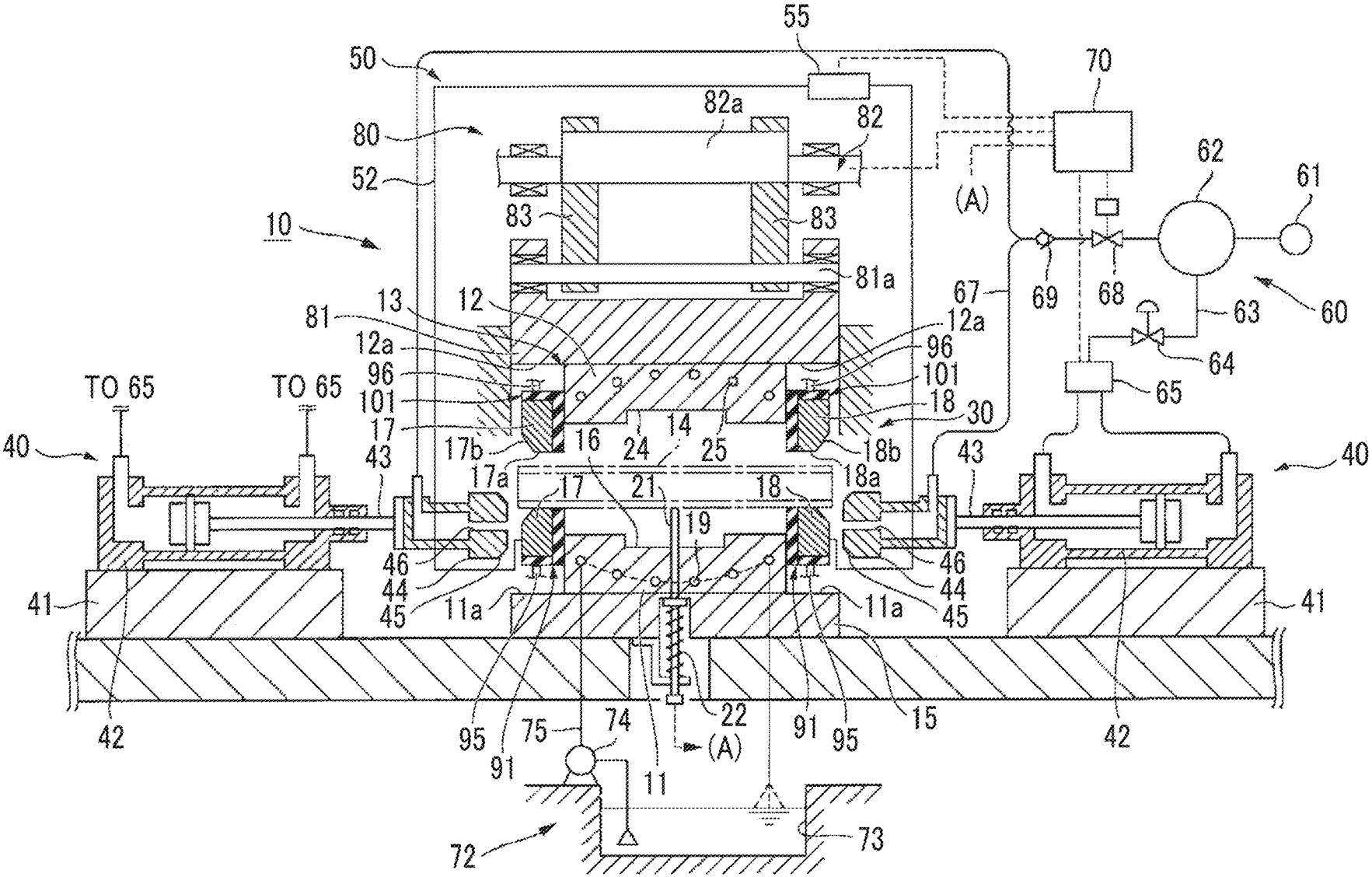
FIG. 1 is a schematic configuration diagram of a forming apparatus according to the present embodiment.

In the forming apparatus of the related art, the metal pipe material is heated by holding both end portions of the metal pipe material with electrodes and energizing each electrode. Here, the electrodes on both sides hold the metal pipe material with substantially the same engagement force and frictional force. In a case where the metal pipe material has expanded with heating, the metal pipe material does not extend evenly from the electrodes on both sides, and in some cases, the amount of expansion of the metal pipe material on either electrode side increases according to a slight difference in engagement force and frictional force. Therefore, the form of expansion changes for each metal pipe material to be formed. In this manner, there is a case where the change in the form of expansion of the metal pipe material affects an error of a process after the heating.

Therefore, it is desirable to provide a forming apparatus in which it is possible to control the form of expansion of a metal pipe material with respect to electrodes on both sides.

According to the forming apparatus of an embodiment of the present invention, the first electrode and the second electrode hold the metal pipe material disposed in the forming die at both end sides. The movement restriction mechanism provided in at least one of the first electrode and the second electrode restricts the movement of the metal pipe material in the axial direction of the metal pipe material. Therefore, in a case where the first electrode and the second electrode heat the metal pipe material by causing an electric current to flow through the metal pipe material, the movement of the expanded metal pipe material is restricted at least on the electrode side where the movement restriction mechanism is provided. By the above, it is possible to control the form of expansion of the metal pipe material with respect to the electrodes on both sides.

In the forming apparatus, the movement restriction mechanism may control at least one of an expansion direction of the metal pipe material and an amount of movement of an end portion of the metal pipe material, as the form of expansion of the metal pipe material.

In the forming apparatus, the movement restriction mechanism may include a protrusion portion which is formed on a contact surface of one of the first electrode and the second electrode and protrudes with respect to the metal pipe material. The movement restriction mechanism is provided in one of the first electrode and the second electrode. Therefore, the expanded metal pipe material is held on the electrode side where the movement restriction mechanism is provided, and extends toward the other electrode side. In this way, it is possible to control the expansion direction of the metal pipe material with respect to the electrodes on both sides. Further, the protrusion portion formed on the contact surface of one of the first electrode and the second electrode bites into and engages with the metal pipe material, so that the movement of the metal pipe material can be restricted with a simple configuration.

In the forming apparatus, the movement restriction mechanism may make a pressing force of a contact surface of one of the first electrode and the second electrode with respect to the metal pipe material larger than a pressing force of a contact surface of the other of the first electrode and the second electrode with respect to the metal pipe material. The movement restriction mechanism is provided in one of the first electrode and the second electrode. Therefore, the expanded metal pipe material is held on the electrode side where the movement restriction mechanism is provided, and extends toward the other electrode side. In this way, it is possible to control the expansion direction of the metal pipe material with respect to the electrodes on both sides. Further, in this way, it is possible to restrict the movement of the metal pipe material 14 by increasing the frictional force between the contact surface of one electrode of the first electrode and the second electrode and the metal pipe material with simple setting of adjusting only the pressing force.

In the forming apparatus, the movement restriction mechanism may include a first restriction member which restricts a movement of the metal pipe material by coming into contact with a first end portion of the metal pipe material on the first electrode side in the axial direction, and a second restriction member which restricts a movement of the metal pipe material by coming into contact with a second end portion of the metal pipe material on the second electrode side in the axial direction. In this way, the movement due to expansion of the first end portion of the metal pipe material is restricted by the first restriction member, and the movement due to expansion of the second end portion of the metal pipe material is restricted by the second restriction member. In this way, the movement restriction mechanism can control the amount of movement of the end portion of the metal pipe material on both sides of the first electrode and the second electrode. By the above, it is possible to control the form of expansion of the metal pipe material with respect to the electrodes on both sides.

The forming apparatus may further include a control unit which controls heating by the first electrode and the second electrode, in which the control unit may consider that the metal pipe material has reached a target temperature, based on the contact of the first end portion with the first restriction member and the contact of the second end portion with the second restriction member. In this way, the control unit can control the amount of movement of both end portions of the metal pipe material by the first restriction member and the second restriction member, and can also control a timing of stop of the heating.

The forming apparatus may further include a control unit which controls movements of the first restriction member and the second restriction member in the axial direction, in which in a case where the control unit has detected that an amount of movement of one end portion of the first end portion and the second end portion of the metal pipe material is larger than an amount of movement of the other end portion, the control unit may move the first restriction member and the second restriction member from the other end portion side to the one end portion side. In this case, in a case where the amount of movement of one end portion of the first end portion and the second end portion of the metal pipe material becomes larger than the amount of movement of the other end portion, it is possible to suppress a load which occurs between the metal pipe material which tries to expand and the restriction member from becoming too large.

In the forming apparatus, the control unit may perform alignment of the metal pipe material in the axial direction by pushing the metal pipe material in the axial direction with at least one of the first restriction member and the second restriction member after stop of the heating by the first electrode and the second electrode. In this case, in a case where the amount of movement of one end portion of the first end portion and the second end portion of the metal pipe material becomes larger than the amount of movement of the other end portion, it is possible to align the metal pipe material at a position suitable for forming after stop of the heating while suppressing a load acting on the metal pipe material from becoming too large during the heating.

The forming apparatus may further include a detection unit which detects the amount of movement of an end portion of the metal pipe material in the axial direction. In this way, it is possible to control the metal pipe material to an appropriate expansion amount.

The forming apparatus may further include a non-contact type detection unit which detects positions of the first end portion and the second end portion in a non-contact manner to detect contact of the first end portion with the first restriction member and contact of the second end portion with the second restriction member. In this case, even if a complicated detection mechanism or the like is not provided at each of the first restriction member and the second restriction member, it is possible to detect the contact between the metal pipe material and the restriction member.

According to the forming apparatus of the present invention, it is possible to control the form of expansion of the metal pipe material with respect to the electrodes on both sides.

Hereinafter, a preferred embodiment of a forming apparatus according to the present invention will be described with reference to the drawings. In each drawing, identical or corresponding portions are denoted by the same reference numerals, and overlapping description will be omitted.

Configuration of Forming Apparatus

FIG. 1 is a schematic configuration diagram of a forming apparatus according to this embodiment. As shown in FIG. 1, a forming apparatus 10 for forming a metal pipe is configured to include a forming die 13 which includes an upper die 12 and a lower die 11, a drive mechanism 80 for moving at least one of the upper die 12 and the lower die 11, a pipe holding mechanism 30 for holding a metal pipe material 14 which is disposed between the upper die 12 and the lower die 11, a heating mechanism 50 for energizing and heating the metal pipe material 14 held by the pipe holding mechanism 30, a gas supply unit 60 for supplying high-pressure gas (gas) into the metal pipe material 14 held between the upper die 12 and the lower die 11 and heated, a pair of gas supply mechanisms (first fluid supply unit and second fluid supply unit) 40 and 40 for supplying the gas from the gas supply unit 60 into the metal pipe material 14 held by the pipe holding mechanism 30, a water circulation mechanism 72 for forcibly water-cooling the forming die 13, and a control unit 70 that controls the drive of the drive mechanism 80, the drive of the pipe holding mechanism 30, the drive of the heating mechanism 50, and the gas supply of the gas supply unit 60.

The lower die 11 which is one side of the forming die 13 is fixed to a base 15. The lower die 11 is formed of a large steel block and has, for example, a rectangular cavity (recessed portion) 16 on the upper surface thereof. A cooling water passage 19 is formed in the lower die 11, and the lower die 11 is provided with a thermocouple 21 inserted from below at substantially the center. The thermocouple 21 is supported by a spring 22 so as to be movable up and down.

Further, a space 11*a* is provided in the vicinity of each of the right and left ends (right and left ends in FIG. 1) of the lower die 11, and electrodes 17 and 18 (lower electrodes) (described later), which are movable parts of the pipe holding mechanism 30, and the like are disposed in the spaces 11*a* so as to be able to move up and down. Then, the metal pipe material 14 is placed on the lower electrodes 17 and 18, whereby the lower electrodes 17 and 18 come into contact with the metal pipe material 14 which is disposed between the upper die 12 and the lower die 11. In this way, the lower electrodes 17 and 18 are electrically connected to the metal pipe material 14.

Insulating materials 91 for preventing electric conduction are respectively provided between the lower die 11 and the lower electrode 17, below the lower electrode 17, between the lower die 11 and the lower electrode 18, and below the lower electrode 18. Each of the insulating materials 91 is fixed to an advancing and retreating rod 95 which is a movable portion of an actuator (not shown) configuring the pipe holding mechanism 30. The actuator is for moving the lower electrodes 17 and 18 and the like up and down, and a fixed portion of the actuator is held on the base 15 side together with the lower die 11.

The upper die 12 which is the other side of the forming die 13 is fixed to a slide 81 (described later) configuring the drive mechanism 80. The upper die 12 is formed of a large steel block and has a cooling water passage 25 formed in the interior thereof and, for example, a rectangular cavity (recessed portion) 24 provided on the lower surface thereof. The cavity 24 is provided at a position facing the cavity 16 of the lower die 11.

Similar to the lower die 11, a space 12*a* is provided in the vicinity of each of the right and left ends (right and left ends in FIG. 1) of the upper die 12, and electrodes 17 and 18 (upper electrodes) (described later), which are movable parts of the pipe holding mechanism 30, and the like are disposed in the spaces 12*a* so as to be movable up and down. Then, the upper electrodes 17 and 18 move downward in a state where the metal pipe material 14 is placed on the lower electrodes 17 and 18, whereby the upper electrodes 17 and 18 come into contact with the metal pipe material 14 disposed between the upper die 12 and the lower die 11. In this way, the upper electrodes 17 and 18 are electrically connected to the metal pipe material 14.

Insulating materials 101 for preventing electric conduction are provided between the upper die 12 and the upper electrode 17, above the upper electrode 17, between the upper die 12 and the upper electrode 18, and above the upper electrode 18. Each of the insulating materials 101 is fixed to an advancing and retreating rod 96 which is a movable portion of the actuator configuring the pipe holding mechanism 30. The actuator is for moving the upper electrodes 17 and 18 and the like up and down, and a fixed portion of the actuator is held on the slide 81 side of the drive mechanism 80 together with the upper die 12.

A semicircular arc-shaped concave groove 18*a* corresponding to the outer peripheral surface of the metal pipe material 14 is formed in each of the surfaces of the electrodes 18 and 18, which face each other, in the right side portion of the pipe holding mechanism 30 (refer to FIGS. 2A to 2C), and the metal pipe material 14 can be placed so as to exactly fit to the portion of the concave groove 18*a*. Similar to the concave groove 18*a*, a semicircular arc-shaped concave groove corresponding to the outer peripheral surface of the metal pipe material 14 is formed in each of exposed surfaces of the insulating materials 91 and 101, which face each other, in the right side portion of the pipe holding mechanism 30. Further, a tapered concave surface 18*b* in which the periphery is recessed to be inclined in a tapered shape toward the concave groove 18*a* is formed on the front surface of the electrode 18 (the surface in an outer direction of the die). Accordingly, a configuration is made such that, if the metal pipe material 14 is clamped from an up-down direction at the right side portion of the pipe holding mechanism 30, the outer periphery of the right end portion of the metal pipe material 14 can be exactly surrounded so as to be in close contact over the entire circumference.

A semicircular arc-shaped concave groove 17*a* corresponding to the outer peripheral surface of the metal pipe material 14 is formed in each of the surfaces of the electrodes 17 and 17, which face each other, in the left side portion of the pipe holding mechanism 30 (refer to FIGS. 2A to 2C), and the metal pipe material 14 can be placed so as to exactly fit to the portion of the concave groove 17*a*. Similar to the concave groove 17*a*, a semicircular arc-shaped concave groove corresponding to the outer peripheral surface of the metal pipe material 14 is formed in each of exposed surfaces of the insulating materials 91 and 101, which face each other, in the left side portion of the pipe holding mechanism 30. Further, a tapered concave surface 17*b* in which the periphery is recessed to be inclined in a tapered shape toward the concave groove 17*a* is formed on the front surface of the electrode 17 (the surface in the outer direction of the die). Accordingly, a configuration is made such that, if the metal pipe material 14 is clamped from the up-down direction at the left side portion of the pipe holding mechanism 30, the outer periphery of the left end portion of the metal pipe material 14 can be exactly surrounded so as to be in close contact over the entire circumference.

As shown in FIG. 1, the drive mechanism 80 includes the slide 81 for moving the upper die 12 such that the upper die 12 and the lower die 11 are combined with each other, a shaft 82 for generating a driving force for moving the slide 81, and a connecting rod 83 for transmitting the driving force generated by the shaft 82 to the slide 81. The shaft 82 extends in a right-left direction above the slide 81, is rotatably supported, and has an eccentric crank 82*a* which protrudes from the right and left ends and extends in the right-left direction at a position separated from the shaft center thereof. The eccentric crank 82*a* and a rotary shaft 81*a* provided above the slide 81 and extending in the right-left direction are connected to each other by the connecting rod 83. In the drive mechanism 80, the height in the up-down direction of the eccentric crank 82*a* is changed by controlling the rotation of the shaft 82 by the control unit 70, and the up-and-down movement of the slide 81 can be controlled by transmitting the positional change of the eccentric crank 82*a* to the slide 81 through the connecting rod 83. Here, the oscillation (rotary motion) of the connecting rod 83, which occurs when the positional change of the eccentric crank 82*a* is transmitted to the slide 81, is absorbed by the rotary shaft 81*a*. The shaft 82 rotates or stops in response to the drive of a motor or the like, which is controlled by the control unit 70, for example.

The heating mechanism 50 includes a power supply unit 55, and a bus bar 52 which electrically connects the power supply unit 55 and the electrodes 17 and 18. The power supply unit 55 includes a direct-current power supply and a switch, and can energize the metal pipe material 14 through the bus bar 52 and the electrodes 17 and 18 in a state where the electrodes 17 and 18 are electrically connected to the metal pipe material 14. Here, the bus bar 52 is connected to the lower electrodes 17 and 18.

In the heating mechanism 50, the direct-current current output from the power supply unit 55 is transmitted by the bus bar 52 and input to the electrode 17. Then, the direct-current current passes through the metal pipe material 14 and is input to the electrode 18. Then, a direct-current current is transmitted by the bus bar 52 to be input to the power supply unit 55.

Figure 2A:
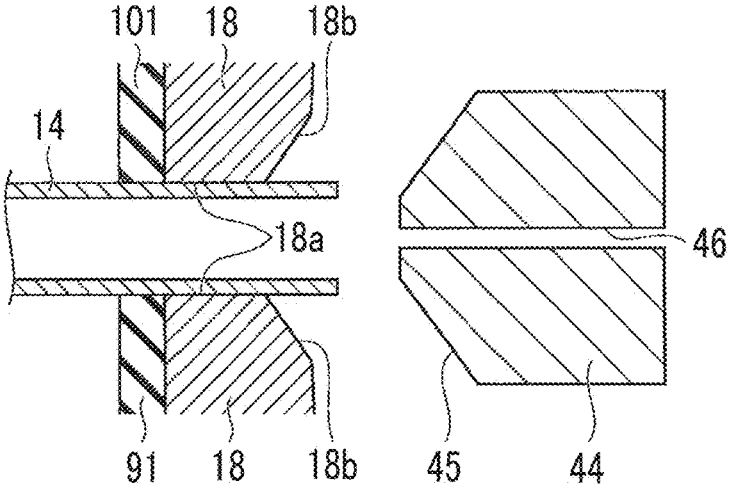
Figure 2B:
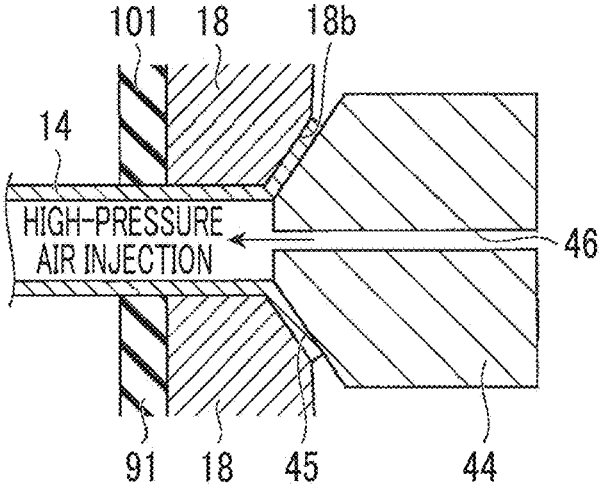
Figure 2C:
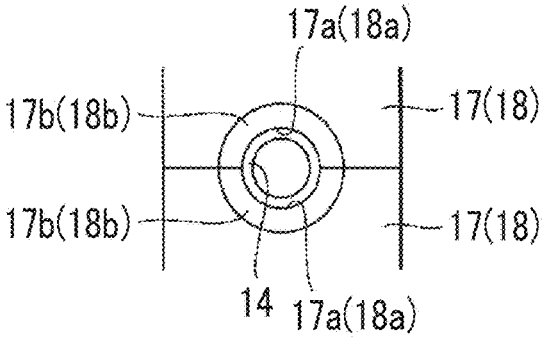

Returning to FIG. 1, each of the pair of gas supply mechanisms 40 includes a cylinder unit 42, a cylinder rod 43 which advances and retreats in accordance with the operation of the cylinder unit 42, and a seal member 44 connected to the tip of the cylinder rod 43 on the pipe holding mechanism 30 side. The cylinder unit 42 is placed on and fixed to a block 41. A tapered surface 45 which is tapered is formed on the tip of the seal member 44, and is configured in a shape which is fitted to the tapered concave surfaces 17*b* and 18*b* of the electrodes 17 and 18 (refer to FIGS. 2A and 2B). A gas passage 46 which extends from the cylinder unit 42 side toward the tip and through which the high-pressure gas supplied from the gas supply unit 60 flows, as specifically shown in FIGS. 2A and 2B, is provided in the seal member 44.

The gas supply unit 60 includes a gas source 61, an accumulator 62 for storing the gas supplied by the gas source 61, a first tube 63 extending from the accumulator 62 to the cylinder unit 42 of the gas supply mechanism 40, a pressure control valve 64 and a switching valve 65 provided in the first tube 63, a second tube 67 extending from the accumulator 62 to the gas passage 46 formed in the seal member 44, and a pressure control valve 68 and a check valve 69 provided in the second tube 67. The pressure control valve 64 plays a role of supplying a gas having an operating pressure adapted to a pressing force of the seal member 44 against the metal pipe material 14 to the cylinder unit 42. The check valve 69 plays a role of preventing the high-pressure gas from flowing backward in the second tube 67. The pressure control valve 68 provided in the second tube 67 plays a role of supplying a gas having an operating pressure for expanding the metal pipe material 14 to the gas passage 46 of the seal member 44 by the control of the control unit 70.

The control unit 70 controls the pressure control valve 68 of the gas supply unit 60 to be able to supply a gas having a desired operating pressure into the metal pipe material 14. Further, the control unit 70 acquires temperature information from the thermocouple 21 from information which is transmitted from (A) shown in FIG. 1, and controls the drive mechanism 80, the power supply unit 55, and the like.

The water circulation mechanism 72 includes a water tank 73 for storing water, a water pump 74 for pumping up the water stored in the water tank 73, pressurizing it, and sending it to the cooling water passage 19 of the lower die 11 and the cooling water passage 25 of the upper die 12, and a pipe 75. Although omitted, a cooling tower for lowering a water temperature or a filter for purifying water may be provided in the pipe 75.

Method of Forming Metal Pipe Using Forming Apparatus

Next, a method of forming a metal pipe using the forming apparatus 10 will be described. First, a quenchable steel grade cylindrical metal pipe material 14 is prepared. The metal pipe material 14 is placed (loaded) on the electrodes 17 and 18 provided on the lower die 11 side by using, for example, a robot arm or the like. Since the concave grooves 17*a* and 18*a* are formed in the electrodes 17 and 18, the metal pipe material 14 is positioned by the concave grooves 17*a* and 18*a*.

Next, the control unit 70 controls the drive mechanism 80 and the pipe holding mechanism 30, thereby causing the pipe holding mechanism 30 to hold the metal pipe material 14. Specifically, the upper die 12, the upper electrodes 17 and 18, and the like held on the slide 81 side move to the lower die 11 side by the drive of the drive mechanism 80, and both end portions of the metal pipe material 14 are clamped from above and below by the pipe holding mechanism 30 by operating the actuator which allows the upper electrodes 17 and 18 and the like and the lower electrodes 17 and 18 and the like, which are included in the pipe holding mechanism 30, to advance and retreat. The clamping is performed in such an aspect as to be in close contact over the entire circumference in the vicinity of both end portions of the metal pipe material 14 due to the presence of the concave grooves 17*a* and 18*a* formed in the electrodes 17 and 18 and the concave grooves formed in the insulating materials 91 and 101.

At this time, as shown in FIG. 2A, the end portion of the metal pipe material 14 on the electrode 18 side protrudes further toward the seal member 44 side than the boundary between the concave groove 18*a* and the tapered concave surface 18*b* of the electrode 18 in an extending direction of the metal pipe material 14. Similarly, the end portion of the metal pipe material 14 on the electrode 17 side protrudes further toward the seal member 44 side than the boundary between the concave groove 17*a* and the tapered concave surface 17*b* of the electrode 17 in the extending direction of the metal pipe material 14. Further, the lower surfaces of the upper electrodes 17 and 18 and the upper surfaces of the lower electrodes 17 and 18 are in contact with each other. However, there is no limitation to the configuration of being in close contact over the entire circumference of each of both end portions of the metal pipe material 14, and a configuration may be made such that the electrodes 17 and 18 are in contact with a part in the circumferential direction of the metal pipe material 14.

Subsequently, the control unit 70 controls the heating mechanism 50 to heat the metal pipe material 14. Specifically, the control unit 70 controls the power supply unit 55 of the heating mechanism 50 to supply electric power. Then, the electric power which is transmitted to the lower electrodes 17 and 18 through the bus bar 52 is supplied to the upper electrodes 17 and 18 clamping the metal pipe material 14 and the metal pipe material 14, and due to resistance which exists in the metal pipe material 14, the metal pipe material 14 itself generates heat by Joule heat. That is, the metal pipe material 14 is in the energized and heated state.

Subsequently, the forming die 13 is closed to the heated metal pipe material 14 by the control of the drive mechanism 80 by the control unit 70. In this way, the cavity 16 of the lower die 11 and the cavity 24 of the upper die 12 are combined, and the metal pipe material 14 is disposed and sealed in the cavity portion between the lower die 11 and the upper die 12.

Thereafter, each of both ends of the metal pipe material 14 is sealed by advancing the seal member 44 by operating the cylinder unit 42 of the gas supply mechanism 40. At this time, as shown in FIG. 2B, the seal member 44 is pressed against the end portion of the metal pipe material 14 on the electrode 18 side, whereby the portion protruding further toward the seal member 44 than the boundary between the concave groove 18*a* and the tapered concave surface 18*b* of the electrode 18 is deformed in a funnel shape so as to follow the tapered concave surface 18*b*. Similarly, the seal member 44 is pressed against the end portion of the metal pipe material 14 on the electrode 17 side, whereby the portion protruding further toward the seal member 44 than the boundary between the concave groove 17*a* and the tapered concave surface 17*b* of the electrode 17 is deformed in a funnel shape so as to follow the tapered concave surface 17*b*. After the completion of the sealing, a high-pressure gas is blown into the metal pipe material 14 to form the metal pipe material 14 softened by heating so as to follow the shape of the cavity portion.

The metal pipe material 14 is softened by being heated to a high temperature (about 950° C.), and therefore, the gas supplied into the metal pipe material 14 thermally expands. For this reason, for example, the gas to be supplied is set to be compressed air, and thus the metal pipe material 14 having a temperature of 950° C. can be easily expanded by the thermally expanded compressed air.

The outer peripheral surface of the blow-formed and expanded metal pipe material 14 is rapidly cooled in contact with the cavity 16 of the lower die 11 and at the same time, is rapidly cooled in contact with the cavity 24 of the upper die 12 (since the upper die 12 and the lower die 11 have large heat capacity and are controlled to a low temperature, if the metal pipe material 14 comes into contact with the upper die 12 and the lower die 11, the heat of the pipe surface is removed to the die side at once), and thus quenching is performed. Such a cooling method is called die contact cooling or die cooling. Immediately after the rapid cooling, austenite is transformed into martensite (hereinafter, the transformation of austenite to martensite is referred to as martensitic transformation). Since a cooling rate is reduced in the second half of the cooling, the martensite is transformed into another structure (troostite, sorbite, or the like) due to reheating. Therefore, it is not necessary to separately perform tempering treatment. Further, in this embodiment, instead of the die cooling or in addition to the die cooling, cooling may be performed by supplying a cooling medium into, for example, the cavity 24. For example, the martensitic transformation may be generated by performing cooling by bringing the metal pipe material 14 into contact with the dies (the upper die 12 and the lower die 11) before a temperature at which the martensitic transformation begins, and then performing the die opening and blowing a cooling medium (cooling gas) to the metal pipe material 14.

As described above, the metal pipe material 14 is blow-formed and then cooled, and then the die opening is performed, thereby obtaining a metal pipe having, for example, a substantially rectangular tubular main body portion.

Figure 3A:
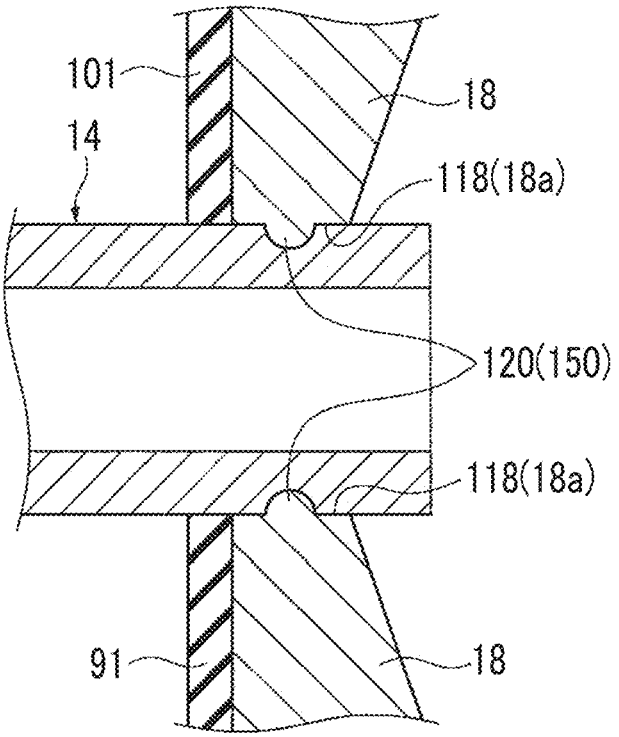
FIGS. 3A and 3B are enlarged diagrams showing a movement restriction mechanism which restricts the movement of a metal pipe material 14 with respect to a contact surface of the electrode.
Figure 3B:
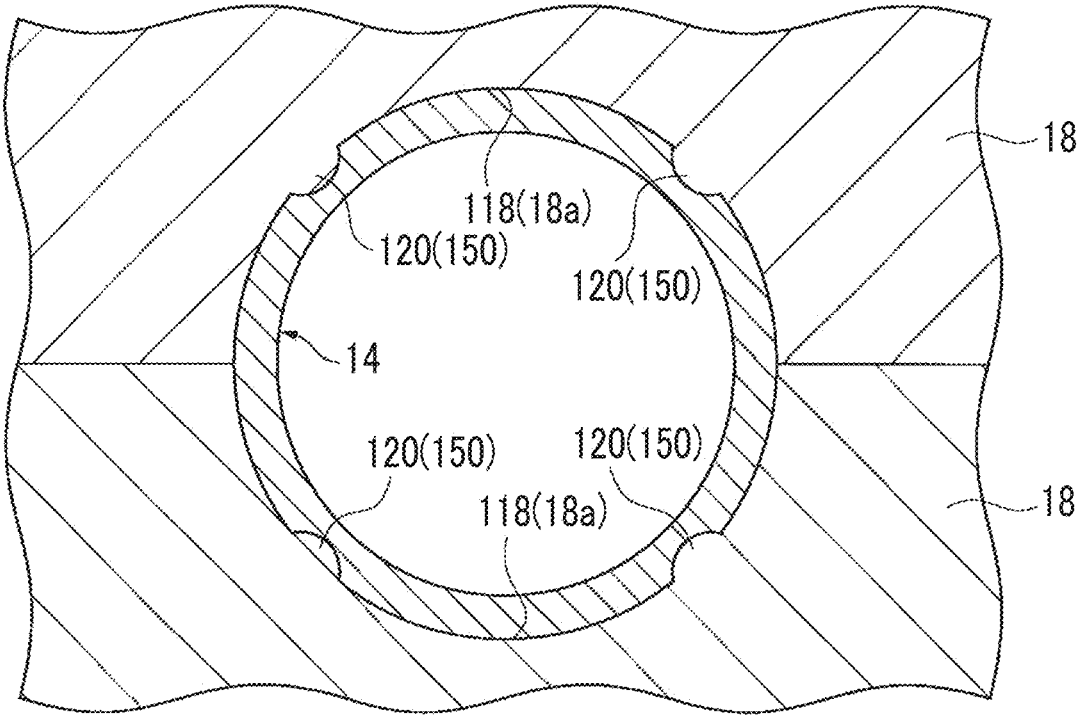
Figure 4A:
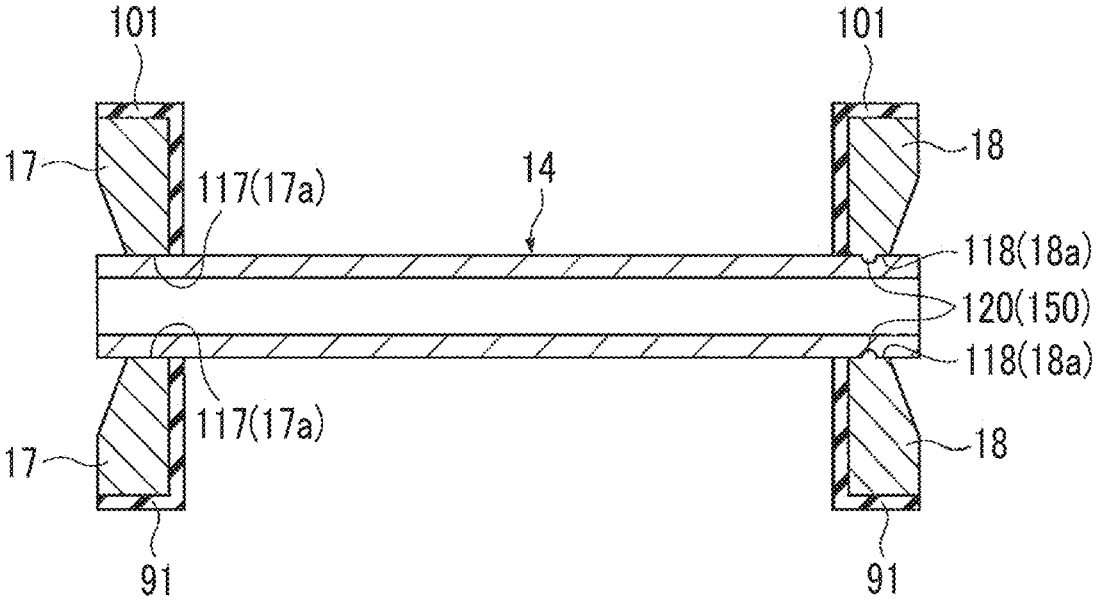
FIGS. 4A and 4B are schematic diagrams for explaining an expansion direction of the metal pipe material with respect to the electrodes on both sides.
Figure 4B:
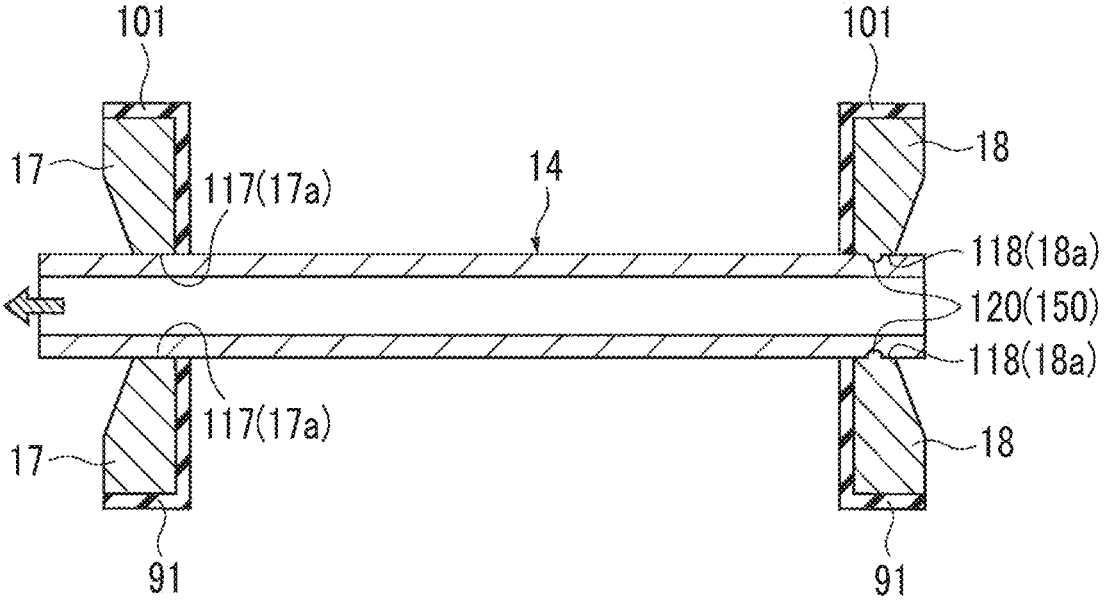

Next, characteristic parts of the forming apparatus 10 according to this embodiment will be described with reference to FIGS. 3A and 3B and FIGS. 4A and 4B. FIGS. 3A and 3B are enlarged diagrams showing a movement restriction mechanism for restricting the movement of the metal pipe material 14 with respect to a contact surface of the electrode. FIGS. 4A and 4B are schematic diagrams for explaining an expansion direction of the metal pipe material with respect to the electrodes on both sides.

In the forming apparatus 10 according to this embodiment, one of the electrode 17 and the electrode 18 is provided with a movement restriction mechanism 150 which restricts the movement of the metal pipe in the axial direction of the metal pipe material 14. The movement restriction mechanism 150 may restrict the movement by the engagement force between the electrode on one side and the metal pipe (the metal pipe material). Alternatively, the movement restriction mechanism 150 may have a structure that increases the frictional force of the contact surface of the electrode on one side. The expression "increasing the frictional force of the contact surface of the electrode on one side" also includes relatively increasing the frictional force of the electrode on one side by reducing the frictional force of the contact surface of the electrode on the other side. The restriction of the movement of the metal pipe by the movement restriction mechanism 150 shall also include the restriction of the movement of the metal pipe material 14 in a state before the completion of the metal pipe. In this embodiment, the movement restriction mechanism 150 performs the movement restriction by the engagement of the contact surface of the electrode with the metal pipe material 14.

In this embodiment, as shown in FIG. 4A, the movement restriction mechanism 150 is configured to make the engagement force of a contact surface 118 of the electrode 18 with the metal pipe material 14 larger than the engagement force of a contact surface 117 of the electrode 17 with the metal pipe material 14. In this case, the electrode 18 corresponds to "one of the first electrode and the second electrode" in the claims, and the electrode 17 corresponds to "the other of the first electrode and the second electrode" in the claims. In this embodiment, the contact surface 118 of the electrode 18 corresponds to the inner peripheral surface of the concave groove 18*a* in each of the upper and lower electrodes 18. The contact surface 117 of the electrode 17 corresponds to the inner peripheral surface of the concave groove 17*a* in each of the upper and lower electrodes 17. A configuration may be made such that the engagement force of the contact surface 117 of the electrode 17 with the metal pipe material 14 becomes larger than the engagement force of the contact surface 118 of the electrode 18 with the metal pipe material 14. In this case, the electrode 17 corresponds to "one of the first electrode and the second electrode" in the claims, and the electrode 18 corresponds to "the other of the first electrode and the second electrode" in the claims.

Specifically, a protrusion portion 120 which protrudes with respect to the metal pipe material 14 is formed on the contact surface 118 of the electrode 18. The movement restriction mechanism 150 is configured with the protrusion portion 120. In particular, as shown in FIG. 3A, the contact surface 118 strongly presses the metal pipe material 14 at the portion of the protrusion portion 120, thereby improving the engagement force with respect to the metal pipe material 14. As shown in FIG. 3B, a plurality of (here, two) protrusion portions 120 are formed at each of the upper and lower electrodes 18. The protrusion portions 120 are formed equally at a constant angle (here, 90°) on the contact surface 118. However, the number of the protrusion portions 120 is not limited, and the protrusion portions 120 may not be equally formed on the contact surface 118. Further, the protrusion portion 120 may be formed at only one of the upper electrode 18 and the lower electrode 18. Further, although the protrusion portion 120 protrudes in a spherical shape, the shape is not particularly limited. For example, the protrusion portion 120 may have a shape that extends in the axial direction or the circumferential direction of the metal pipe material 14. In the drawings, the amount of protrusion of the protrusion portion 120 is emphasized for easy understanding. On the other hand, the protrusion portion 120 is not formed on the contact surface 117 of the electrode 17.

The operation and effects of the forming apparatus 10 according to this embodiment will be described.

Figure 6A:
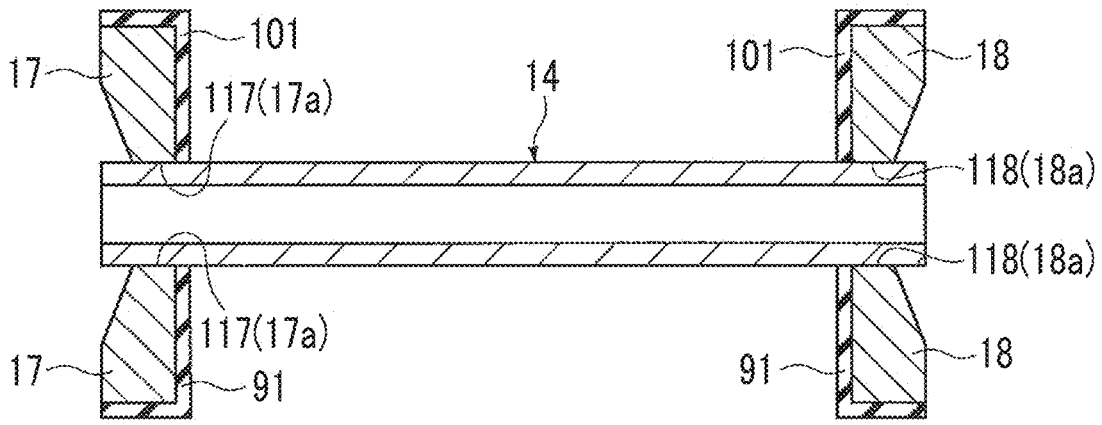
FIGS. 6A to 6C are schematic diagrams for explaining the expansion direction of the metal pipe material with respect to electrodes on both sides of a forming apparatus according to a comparative example.
Figure 6B:
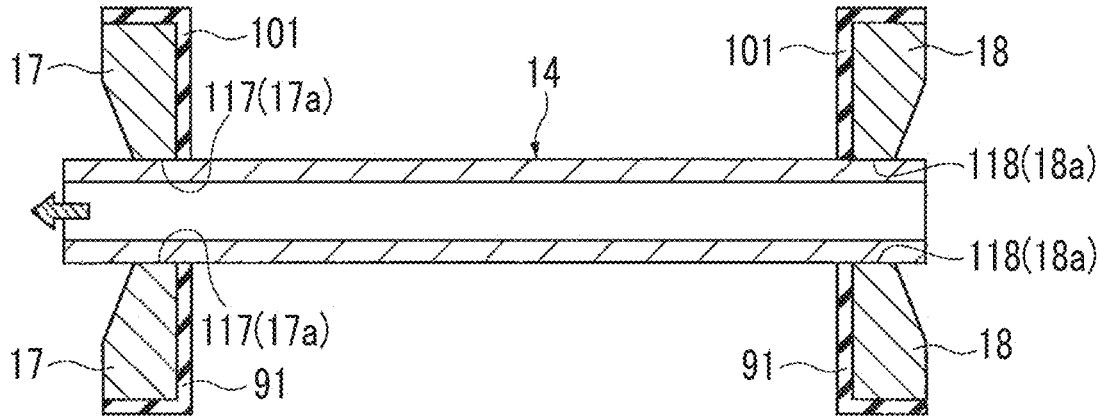
Figure 6C:
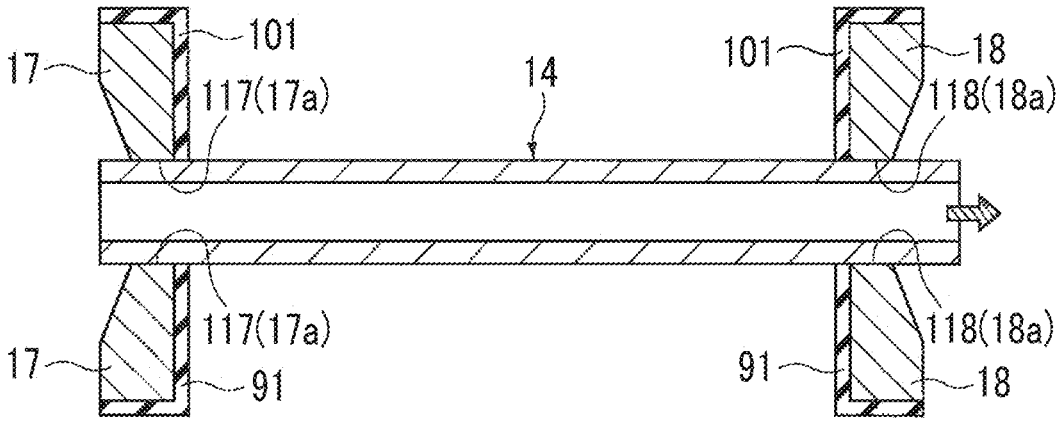

First, a forming apparatus according to a comparative example will be described with reference to FIGS. 6A to 6C. In the forming apparatus according to the comparative example, both the electrodes 17 and 18 hold the metal pipe material with substantially the same engagement force and frictional force. In a case where the metal pipe material 14 expands with heating, the metal pipe material 14 does not extend equally from the electrodes 17 and 18 on both sides, and the metal pipe material extends from either of the electrode 17 side or the electrode 18 side according to a slight difference in engagement force and frictional force. For example, in a certain metal pipe material 14, as shown in FIG. 6B, the metal pipe material 14 extends from the electrode 17 side. On the other hand, in the other metal pipe material 14, as shown in FIG. 6C, the metal pipe material 14 extends from the electrode 18 side. That is, the expansion direction changes for each metal pipe material 14 to be formed. In this manner, there is a case where the change in the expansion direction of the metal pipe material 14 affects an error of the process after heating. For example, the pushing amount of the seal members 44 of the gas supply mechanisms 40 and 40 varies depending on the expansion direction of the metal pipe material 14, and therefore, there is a case where it affects an error during forming.

In contrast, according to the forming apparatus 10 of this embodiment, the electrodes 17 and 18 clamp the metal pipe material 14 disposed in the forming die 13 at both end sides. The contact surface 118 of the electrode 18 is provided with the movement restricting mechanism 150 which restricts the movement of the metal pipe in the axial direction of the metal pipe material 14. Therefore, in a case where the electrode 18 and the electrode 17 cause an electric current to flow through the metal pipe material 14 to heat the metal pipe material 14, as shown in FIG. 4B, the expanded metal pipe material 14 is held on the electrode 18 side where the movement restriction mechanism 150 is provided, and extends toward the electrode 17 side. By the above, it is possible to control the expansion direction of the metal pipe material 14 with respect to the electrodes 17 and 18 on both sides.

Further, in the forming apparatus 10, the movement restriction mechanism 150 is configured with the protrusion portion 120 which is formed on the contact surface 118 of the electrode 18 and protrudes with respect to the metal pipe material 14. The protrusion portion 120 formed on the contact surface 118 of the electrode 18 bites into and engages with the metal pipe material 14, so that the movement of the metal pipe can be restricted with a simple configuration.

The present invention is not limited to the embodiment described above.

For example, instead of the configuration of restricting the movement by using the protrusion portion as shown in FIGS. 4A and 4B, the movement may be restricted by using a difference in frictional force between the electrodes. In the following configuration, the frictional force is increased by increasing the pressing force of the electrode on one side with respect to the metal pipe material 14.

That is, one of the electrode 17 and the electrode 18 is provided with the movement restriction mechanism 150 which makes the frictional force between the contact surface of the electrode on one side and the metal pipe material 14 larger than the frictional force between the contact surface of the electrode on the other side and the metal pipe material 14. The "frictional force" is a force acting in the direction opposite to a movement direction in a case where the outer peripheral surface of the metal pipe material 14 tries to move relative to the contact surface in the axial direction (for example, due to thermal expansion or the like).

In this embodiment, a configuration is made such that the frictional force between the contact surface 118 of the electrode 18 and the metal pipe material 14 becomes larger than the frictional force between the contact surface 117 of the electrode 17 and the metal pipe material 14. That is, the movement restriction mechanism 150 makes the frictional force between the contact surface 118 of the electrode 18 and the metal pipe material 14 larger than the frictional force between the contact surface 117 of the electrode 17 and the metal pipe material 14. In this case, the electrode 18 corresponds to "one of the first electrode and the second electrode" in the claims, and the electrode 17 corresponds to "the other of the first electrode and the second electrode" in the claims. A configuration may be made such that the frictional force between the contact surface 117 of the electrode 17 and the metal pipe material 14 becomes larger than the frictional force between the contact surface 118 of the electrode 18 and the metal pipe material 14. In this case, the electrode 17 corresponds to "one of the first electrode and the second electrode" in the claims, and the electrode 18 corresponds to "the other of the first electrode and the second electrode" in the claims.

Figure 5A:
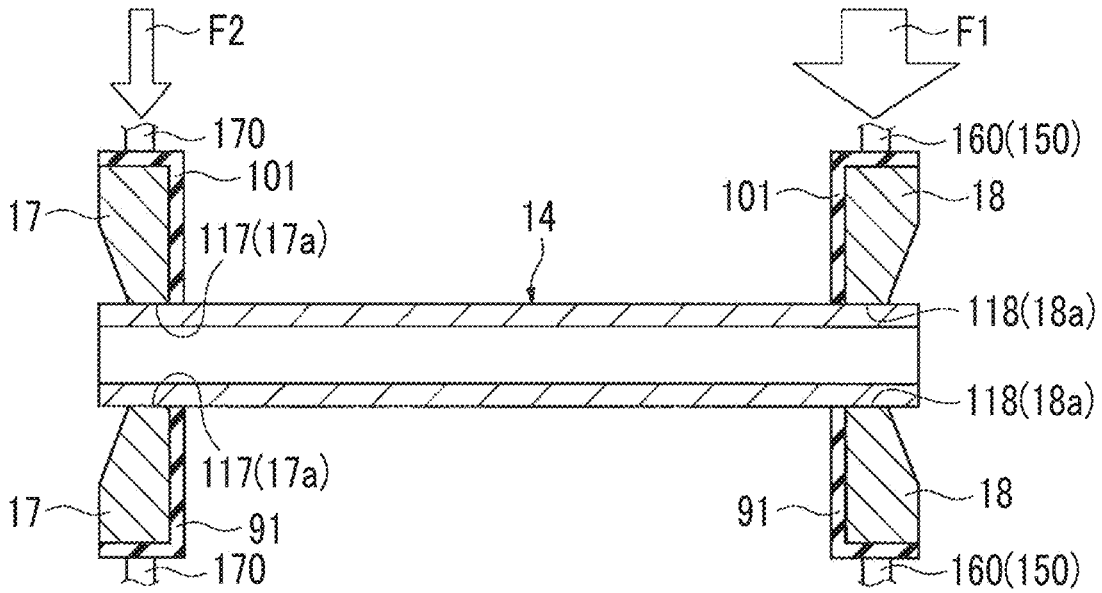
FIGS. 5A and 5B are schematic diagrams for explaining the expansion direction of the metal pipe material with respect to electrodes on both sides of a forming apparatus according to a modification example.
Figure 5B:
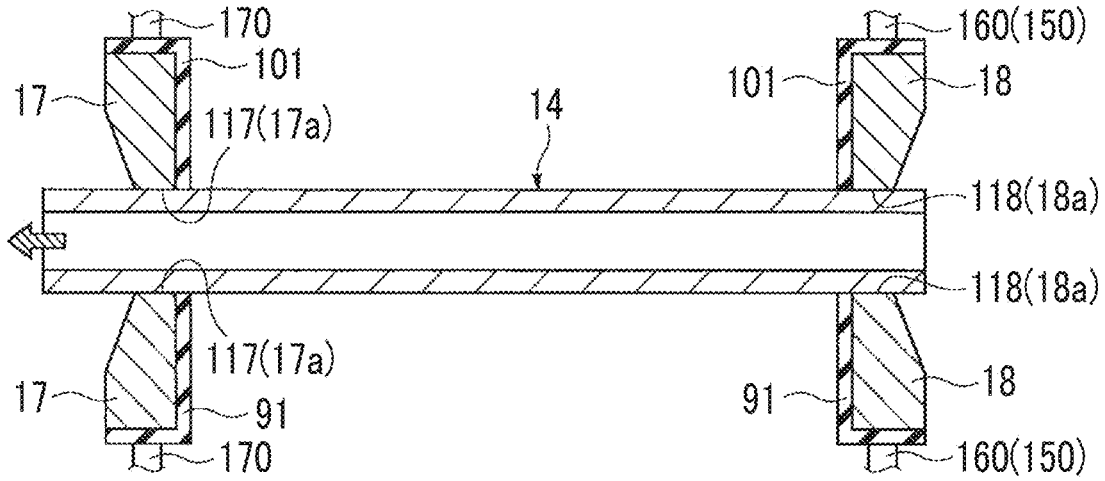

More specifically, as shown in FIG. 5A, a pressing force F1 of the contact surface 118 of the electrode 18 with respect to the metal pipe material 14 is larger than a pressing force F2 of the contact surface 117 of the electrode 17 with respect to the metal pipe material 14. Therefore, in a case where the electrode 18 and the electrode 17 cause an electric current to flow through the metal pipe material 14 to heat the metal pipe material 14, as shown in FIG. 5B, the expanded metal pipe material 14 is held on the electrode 18 side where the frictional force is larger, and extends toward the electrode 17 side where the frictional force is smaller. In this way, it is possible to increase the frictional force between the contact surface 118 of the electrode 18 and the metal pipe material 14 with simple setting of adjusting only the pressing force. The adjustment of the pressing force can be realized by setting different values as the setting value of an actuator 160 that drives the electrode 18 and the setting value of an actuator 170 that drives the electrode 17. In this form, the movement restriction mechanism 150 is configured with the actuator 160 in which a larger pressing force is set.

In addition, the configuration of the movement restriction adjustment mechanism which adjusts the frictional force between the contact surface of the electrode and the metal pipe material is not particularly limited. For example, the frictional force may be adjusted by adjusting the roughness of the contact surface. In this case, the contact surface having a higher roughness than the contact surface of the electrode on the other side corresponds to the movement restriction mechanism.

In the embodiment described above, the gas supply mechanism is adopted as the fluid supply unit. However, the fluid is not limited to gas, and liquid may be supplied.

Further, as shown in FIGS. 7A and 7B, FIGS. 8A and 8B, and FIGS. 9A and 9B, the forming apparatus may further include a detection unit which detects the amount of movement of the end portion of the metal pipe material 14 in the axial direction. In this way, it is possible to control the metal pipe material 14 to an appropriate expansion amount.

Figure 7B:
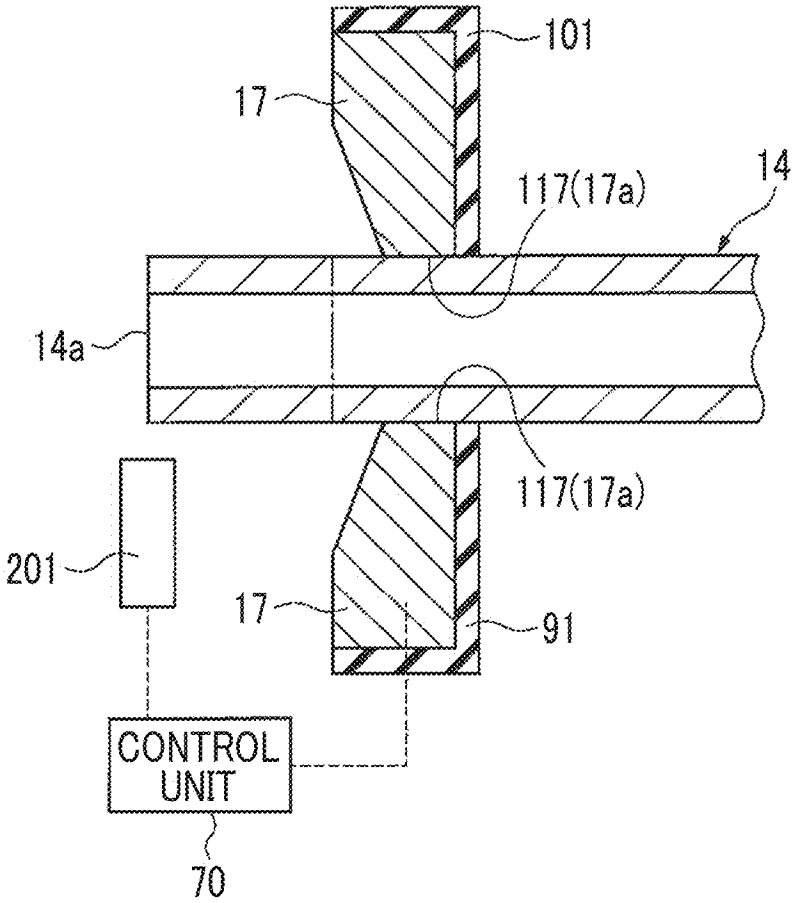
FIGS. 7A and 7B are schematic diagrams showing a forming apparatus according to a modification example.
Figure 7A:
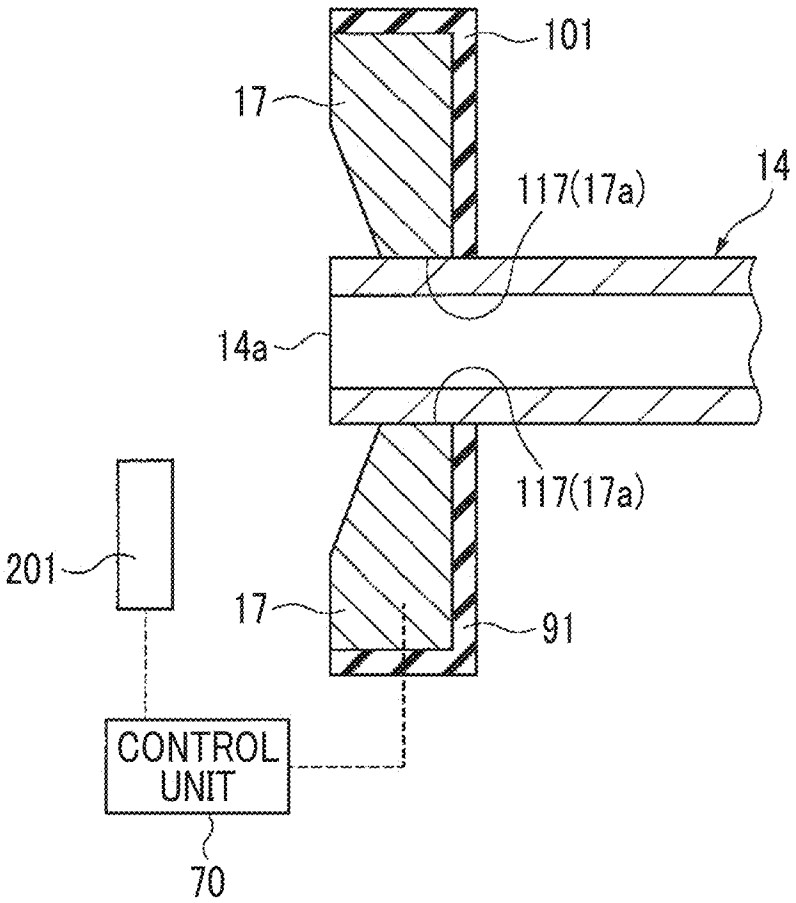

Specifically, as shown in FIGS. 7A and 7B, the forming apparatus may include a proximity switch 201 which detects the proximity of an end portion 14*a* of the metal pipe material 14 in a non-contact manner. The end portion 14*a* is an end portion on the electrode 17 side where the movement restriction mechanism is not provided, and the movement of the metal pipe material 14 is restricted by the movement restriction mechanism on the other electrode 18 side. The proximity switch 201 detects the proximity of the end portion 14*a* in a case where the end portion 14*a* has approached a predetermined range. The proximity switch 201 is a high magnetic field resistant switch. Therefore, even if the surroundings is in a high magnetic field due to energization heating, the proximity switch 201 can normally perform the detection. Further, the forming apparatus includes the control unit 70. The control unit 70 is electrically connected to the proximity switch 201 and can receive a detection result detected by the proximity switch 201. Further, the control unit 70 is electrically connected to the electrodes 17 and 18 and can control the energization heating of the electrodes 17 and 18.

Here, the amount of expansion when the metal pipe material 14 has reached a target temperature (or the full length of the metal pipe material 14 at the time of the completion of heating) can be grasped in advance by experiments, calculations, or the like. Therefore, the proximity switch 201 can grasp in advance an expected arrival position where the end portion 14*a* reaches when the metal pipe material 14 has reached the target temperature. Therefore, the proximity switch 201 is disposed at the expected arrival position of the end portion 14*a*. Further, the control unit 70 stops the energization heating at a timing when the proximity switch 201 has detected the proximity of the end portion 14*a*. In this way, the control unit 70 can appropriately stop the energization heating at a timing when the metal pipe material 14 has reached the target temperature, based on the detection result of the proximity switch 201.

Figure 8B:
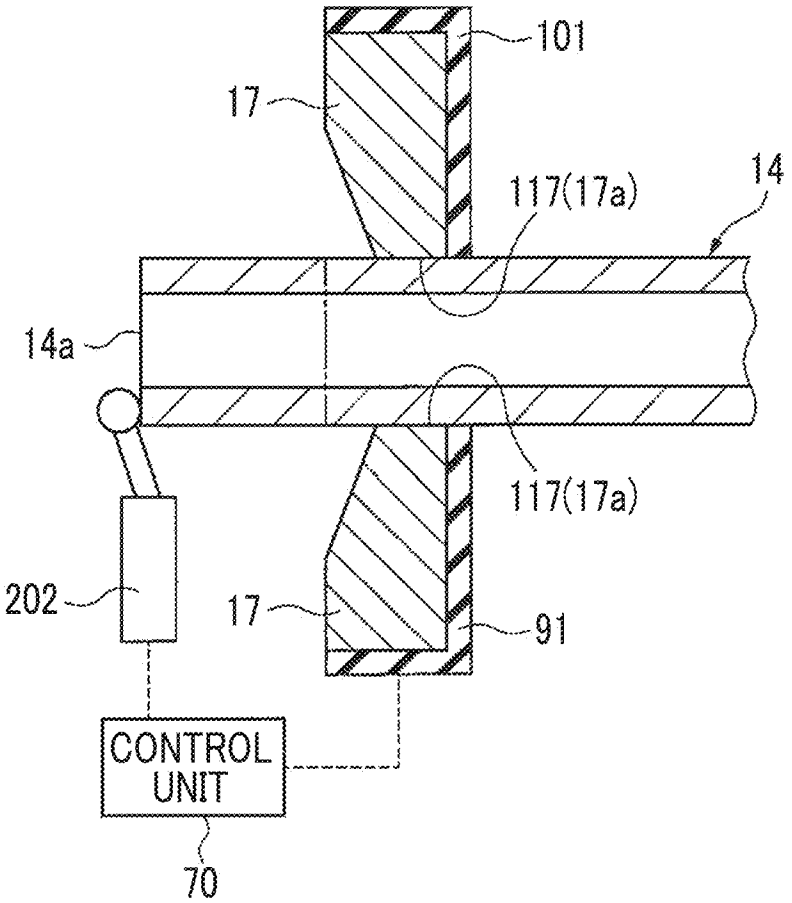
FIGS. 8A and 8B are schematic diagrams showing a forming apparatus according to a modification example.
Figure 8A:
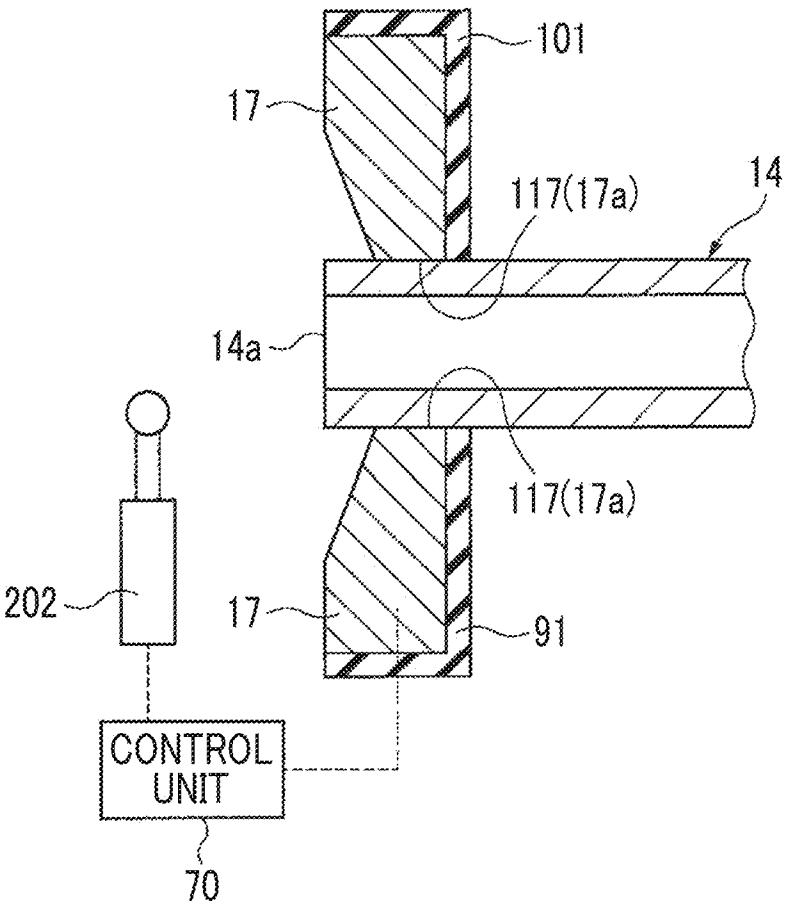

As shown in FIGS. 8A and 8B, the forming apparatus may include a limit switch 202 which detects the contact with the end portion 14*a* of the metal pipe material 14. Also in this case, the end portion 14*a* is an end portion on the electrode 17 side where the movement restriction mechanism is not provided, and the movement of the metal pipe material 14 is restricted by the movement restriction mechanism on the other electrode 18 side. The limit switch 202 detects the arrival of the end portion 14*a* by coming into contact with the end portion 14*a* when the end portion 14*a* has reached the expected arrival position described above. A kicker portion (a contact portion with the end portion 14*a*) of the limit switch 202 is formed of a heat-resistant insulating material, for example, alumina ceramics. The control unit 70 stops the energization heating at a timing when the limit switch 202 has detected the contact with the end portion 14*a*. In this way, the control unit 70 can appropriately stop the energization heating at a timing when the metal pipe material 14 has reached the target temperature, based on the detection result of the limit switch 202.

Figure 9B:
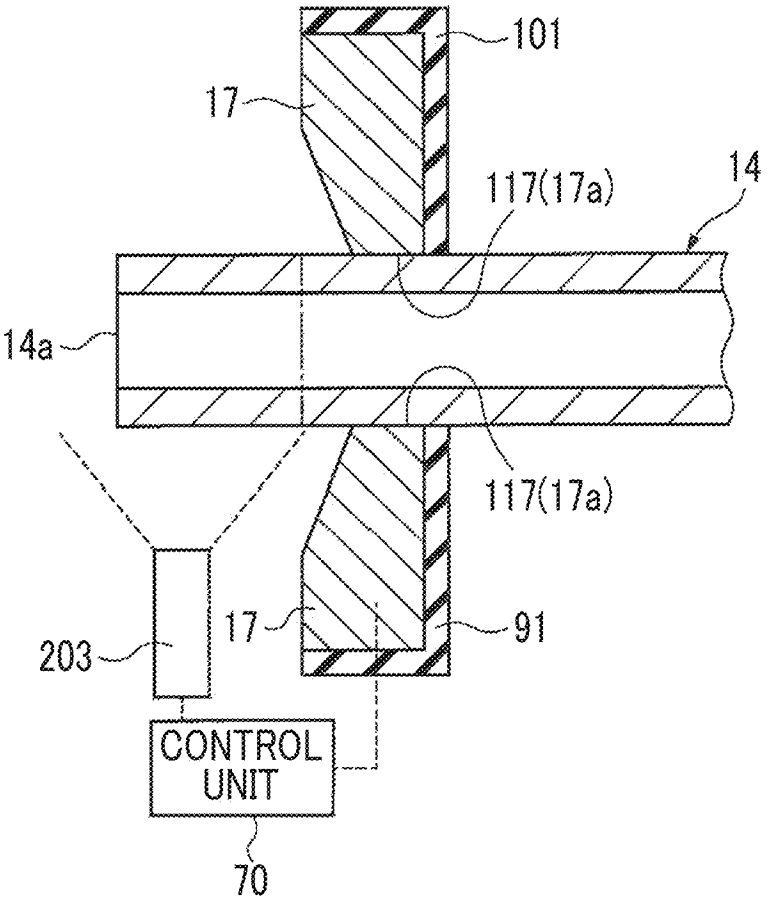
FIGS. 9A and 9B are schematic diagrams showing a forming apparatus according to a modification example.
Figure 9A:
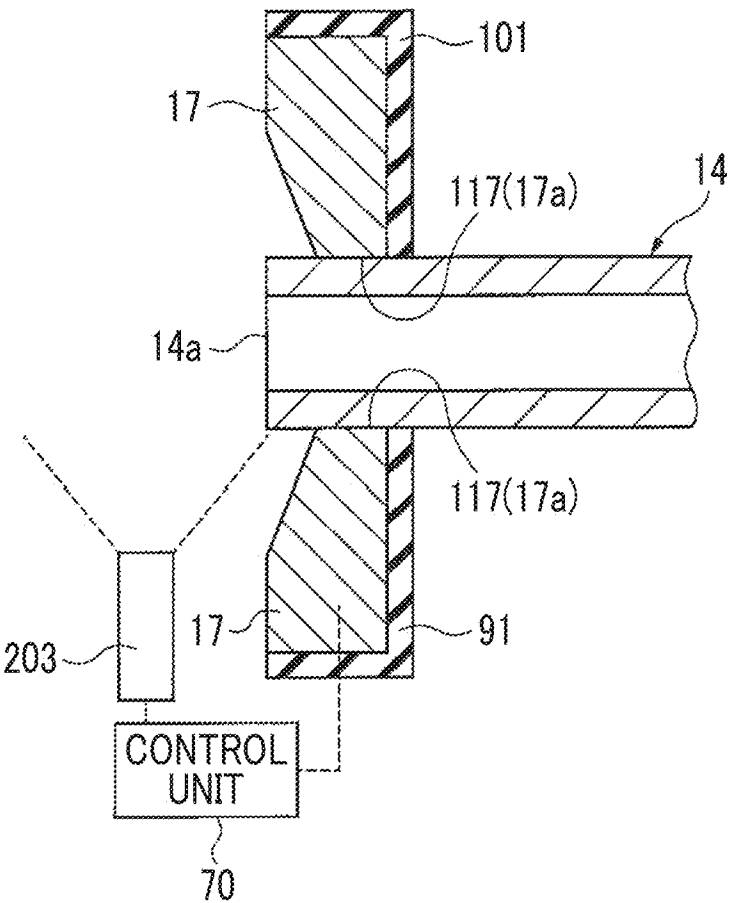

As shown in FIGS. 9A and 9B, the forming apparatus may include an imaging unit 203 that is a camera-type sensor which detects the amount of movement of the end portion 14*a* of the metal pipe material 14 in a non-contact manner. In this case, the end portion 14*a* is an end portion on the electrode 17 side where the movement restriction mechanism is not provided, and the movement of the metal pipe material 14 may be restricted by the movement restriction mechanism on the other electrode 18 side. However, in a case where the imaging unit 203 is used, the movement of the metal pipe material 14 due to expansion may be allowed in both the electrodes 17 and 18 (a specific example will be described later). The imaging unit 203 can detect the position of the end portion 14*a*, that is, the amount of movement of the end portion 14*a*, by acquiring the image of the end portion 14*a*. Therefore, the imaging unit 203 detects the arrival of the end portion 14*a* at the expected arrival position described above, based on the acquired image. The disposition of the imaging unit 203 is not particularly limited as long as the image of the end portion 14*a* can be acquired, and may be disposed at a position away from an energization heating portion. Therefore, the imaging unit 203 may not be a high magnetic field resistant sensor, like the proximity switch 201. The control unit 70 stops the energization heating at a timing when the imaging unit 203 has detected the arrival of the end portion 14*a* at the expected arrival position. In this way, the control unit 70 can appropriately stop the energization heating at a timing when the metal pipe material 14 has reached the target temperature, based on the detection result of the imaging unit 203.

Figure 10:
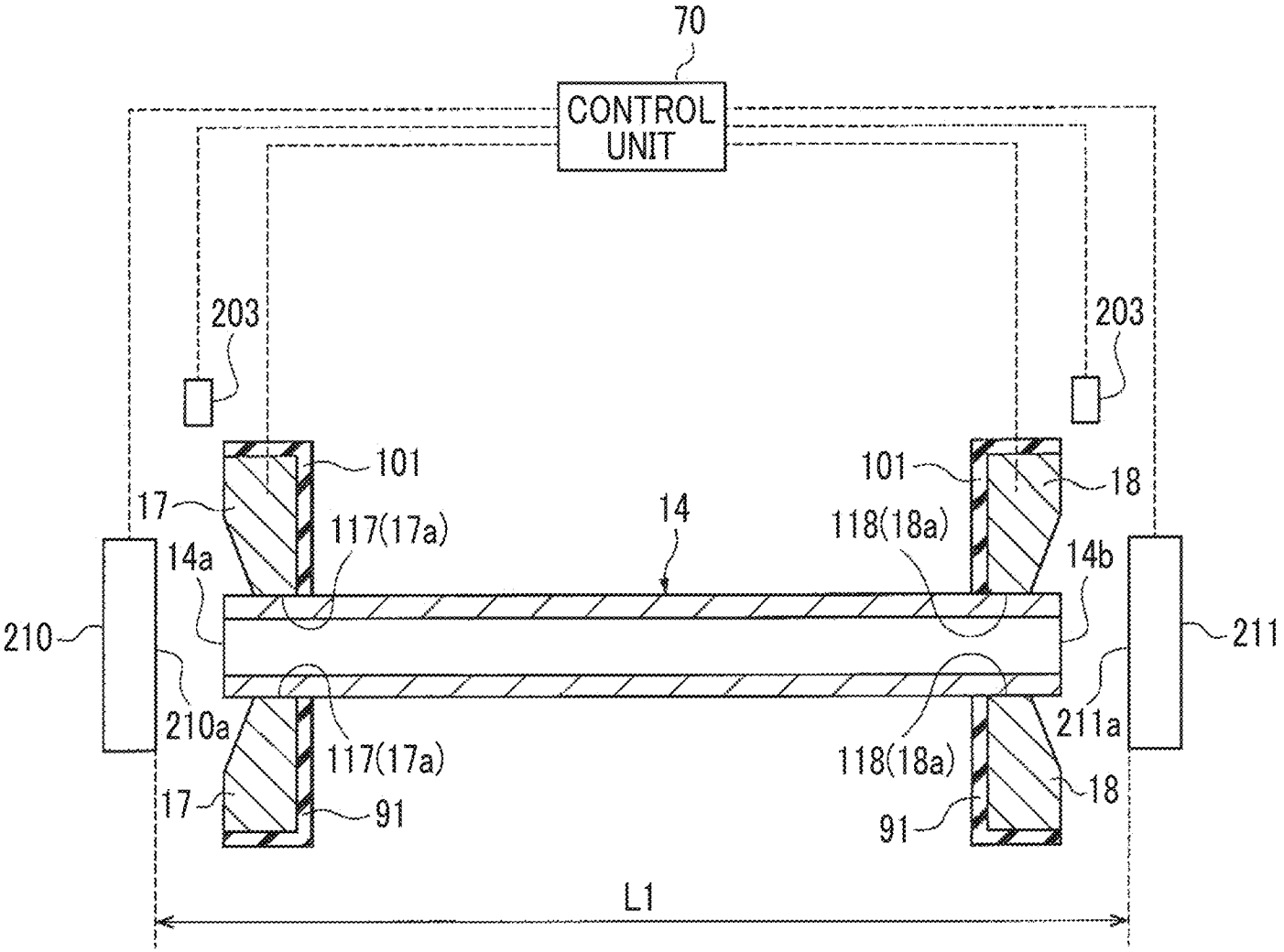
FIG. 10 is a schematic diagram showing a forming apparatus according to a modification example.

Further, the configuration shown in FIG. 10 may be adopted as a forming apparatus according to a modification example. A movement restriction mechanism shown in FIG. 10 includes a restriction member (a first restriction member) 210 which restricts the movement of the metal pipe material 14 by coming into contact with the end portion (a first end portion) 14*a* on the electrode 17 side in the axial direction of the metal pipe material 14, and a restriction member (a second restriction member) 211 which restricts the movement of the metal pipe material 14 by coming into contact with an end portion (a second end portion) 14*b* on the electrode 18 side in the axial direction of the metal pipe material 14. Further, the forming apparatus includes an imaging unit 203 which detects the amount of movement of the end portion 14*a*, and an imaging unit 203 which detects the amount of movement of the end portion 14*b*.

The control unit 70 is electrically connected to the imaging units 203 and 203 and can receive the amount of movement of each of the end portions 14*a* and 14*b* detected by each of the imaging units 203 and 203. Further, the control unit 70 is electrically connected to the electrodes 17 and 18 and can control the energization heating of the electrodes 17 and 18 and the opening and closing of a clamp.

The restriction member 210 has a contact surface 210*a* which extends substantially perpendicular to the axial direction so as to face the end portion 14*a*. The restriction member 211 has a contact surface 211*a* which extends substantially perpendicular to the axial direction so as to face the end portion 14*b*. The restriction members 210 and 211 can be moved in the axial direction by a drive unit (not shown). The control unit 70 is electrically connected to the restriction members 210 and 211 and can control the movements of the restriction members 210 and 211 in the axial direction.

In the state before the energization heating, the restriction members 210 and 211 are disposed at positions separated from the respective end portions 14*a* and 14*b* in the axial direction. At this time, a separation distance L1 in the axial direction between the contact surface 210*a* and the contact surface 211*a* is set to be substantially the same as the full length of the metal pipe material 14 when the metal pipe material 14 has reached the target temperature (the full length of the metal pipe material 14 in the state of FIG. 11B).

In FIG. 10, the protrusion amount of the end portion 14*a* from the electrode 17 and the protrusion amount of the end portion 14*b* from the electrode 18 are the same, and therefore, the separation distance of the restriction member 210 from the end portion 14*a* and the separation distance of the restriction member 211 from the end portion 14*b* are set to be the same. However, depending on the relationship between the protrusion amount of the end portion 14*a* from the electrode 17 and the protrusion amount of the end portion 14*b* from the electrode 18, the separation distance of the restriction member 210 from the end portion 14*a* and the separation distance of the restriction member 211 from the end portion 14*b* may not be the same.

Figure 11A:
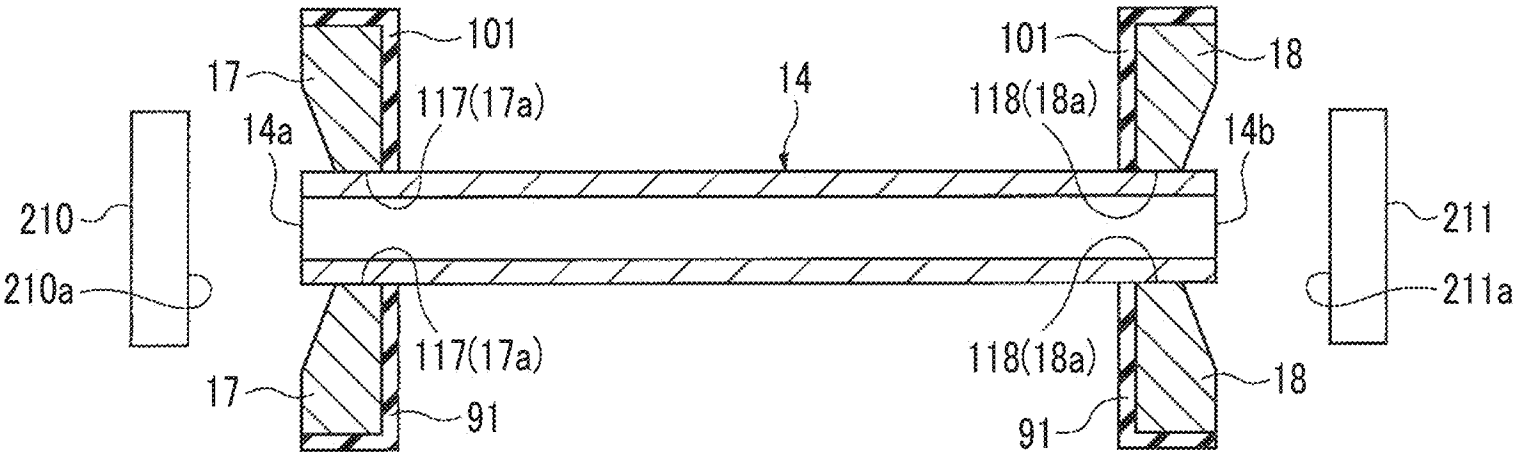
FIGS. 11A and 11B are schematic diagrams showing an operation of a forming apparatus according to a modification example.
Figure 11B:
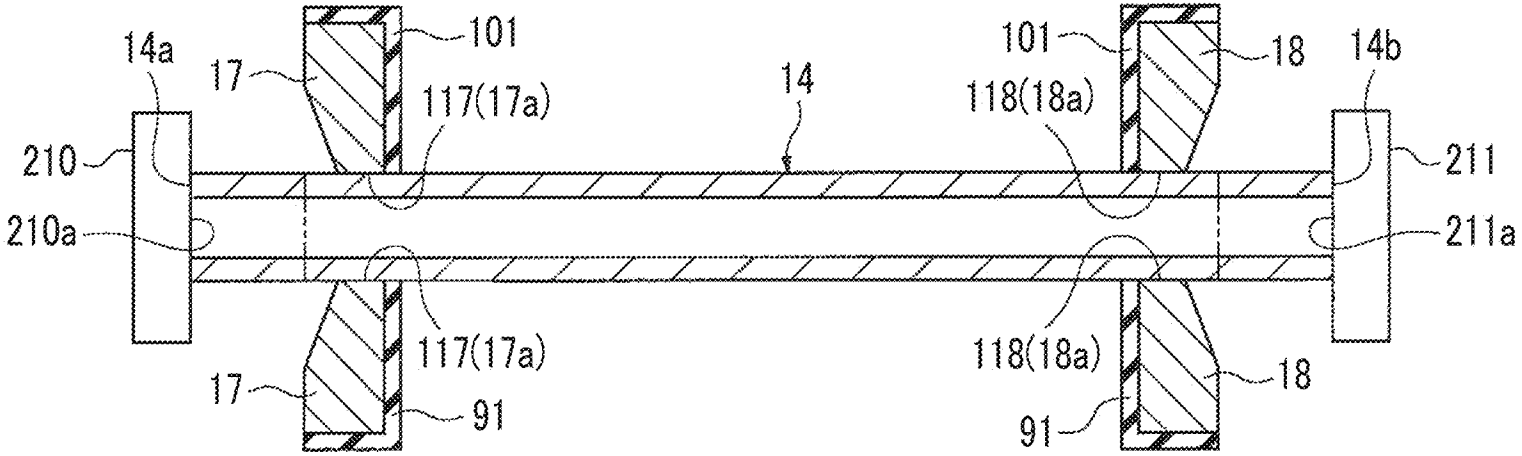

The electrodes 17 and 18 according to this modification example do not have the movement restriction mechanisms as shown in FIGS. 4A and 4B and FIGS. 5A and 5B. Therefore, if the energization heating is started from the state before the energization heating in FIG. 11A, the metal pipe material 14 expands toward both sides in the axial direction. Both the end portion 14*a* and the end portion 14*b* move outward in the axial direction. As shown in FIG. 11B, in a case where the end portion 14*a* has come into contact with the restriction member 210, the end portion 14*a* stops at the position, and the amount of movement of the end portion 14*a* does not increase any more. Further, in a case where the end portion 14*b* has come into contact with the restriction member 211, the end portion 14*b* stops at the position, and the amount of movement of the end portion 14*b* does not increase any more.

For example, in a case where a timing when the end portion 14*a* comes into contact with the restriction member 210 and a timing when the end portion 14*b* comes into contact with the restriction member 211 are substantially the same, the restriction members 210 and 211 can control the amount of expansion such that the metal pipe material 14 does not extend any more due to expansion.

Further, for example, in a case where the end portion 14*a* first comes into contact with the restriction member 210, the movement of the end portion 14*a* is restricted by the restriction member 210. Thereafter, the metal pipe material 14 expands from the electrode 17 side toward the electrode 18 side with the position of the end portion 14*a* in which the movement has been restricted as the reference. Thereafter, the end portion 14*b* comes into contact with the restriction member 211. In this way, the restriction members 210 and 211 can control the amount of expansion such that the metal pipe material 14 does not extend any more due to expansion. In this manner, in a case where a difference occurs in the timing of the contact with the restriction member between the end portion 14*a* and the end portion 14*b*, it is preferable that the difference in the timing is within the range of a predetermined allowable value such that buckling does not occur in the metal pipe material 14. The operation in a case where it does not fall within the range of the allowable value will be described later with reference to FIGS. 12A and 12B, FIGS. 13A and 13B, and FIGS. 14A and 14B. Alternatively, in a case where a difference occurs in the timing of the contact with the restriction member between the end portion 14*a* and the end portion 14*b*, it is preferable that the electrodes 17 and 18 have a configuration in which the metal pipe material 14 can easily slide in the axial direction (a configuration in which a clamping force is loosened, or a configuration in which a frictional force is reduced).

As described above, the separation distance L1 between the restriction members 210 and 211 is set to the full length of the metal pipe material 14 when the metal pipe material 14 has reached the target temperature. Therefore, when the end portion 14*a* has come into contact with the restriction member 210 and the end portion 14*b* has come into contact with the restriction member 211, the control unit 70 recognizes that the metal pipe material 14 has reached the target temperature, based on the contact of the end portion 14*a* with the restriction member 210 and the contact of the end portion 14*b* with the restriction member 211. The control unit 70 grasps that the end portion 14*a* has come into contact with the restriction member 210 and that the end portion 14*b* has come into contact with the restriction member 211, based on the detection results of the imaging units 203. At this time, the control unit 70 stops the energization heating by the electrodes 17 and 18. In the example shown in FIG. 11B, the separation distance of the restriction member 210 from the electrode 17 and the separation distance of the restriction member 211 from the electrode 18 are set to be the same. Therefore, the amount of movement of the end portion 14*a* of the metal pipe material 14, that is, the amount of elongation due to expansion on the end portion 14*a* side, and the amount of movement of the end portion 14*b* of the metal pipe material 14, that is, the amount of elongation due to expansion on the end portion 14*b* side, become uniform.

As described above, in the forming apparatus according to the modification example, the movement restriction mechanism includes the restriction member 210 which restricts the movement of the metal pipe material 14 by coming into contact with the end portion 14*a* on the electrode 17 side in the axial direction of the metal pipe material 14, and the restriction member 211 which restricts the movement of the metal pipe material 14 by coming into contact with the end portion 14*b* on the electrode 18 side in the axial direction of the metal pipe material 14. In this way, the movement of the end portion 14*a* of the metal pipe material 14 due to expansion is restricted by the restriction member 210, and the movement of the end portion 14*b* of the metal pipe material 14 due to expansion is restricted by the restriction member 211. The movement restriction mechanism can control the amount of movement of each of the end portions 14*a* and 14*b* of the metal pipe material 14 on both sides of the electrode 17 and the electrode 18. By the above, it is possible to control the form of expansion of the metal pipe material 14 with respect to the electrodes 17 and 18 on both sides.

In the embodiment described above, the metal pipe material 14 has a shape extending straight. However, it may have a shape curved as a whole. In this case, a temperature difference easily occurs in the metal pipe material 14, so that the form of expansion becomes further complicated. Even in such a case, the form of expansion of the curved metal pipe material can also be appropriately controlled by using the forming apparatus according to the modification example.

The forming apparatus further includes the control unit 70 which controls the heating by the electrode 17 and the electrode 18, and the control unit 70 recognizes that the metal pipe material 14 has reached the target temperature, based on the contact of the end portion 14*a* with the restriction member 210 and the contact of the end portion 14*b* with the restriction member 211. In this way, the control unit 70 can control the amount of movement of both end portions of the metal pipe material 14 by the restriction member 210 and the restriction member 211 and can also control a timing of the stop of the heating.

The forming apparatus further includes the imaging units 203 that are non-contact type detection units which detect the positions of the end portion 14*a* and the end portion 14*b* in a non-contact manner, thereby detecting the contact of the end portion 14*a* with the restriction member 210 and the contact of the end portion 14*b* with the restriction member 211. In this case, even if a complicated detection mechanism (a mechanism for detecting a load acting on each of the restriction members 210 and 211) or the like is not provided in each of the restriction member 210 and the restriction member 211, it is possible to detect the contact of the metal pipe material 14 with the restriction members 210 and 211. However, the forming apparatus may detect the contact with the end portions 14*a* and 14*b* by a mechanism for detecting a load acting on each of the restriction members 210 and 211, instead of the imaging unit 203.

Here, in a case where the amount of movement of one end portion of the end portion 14*a* and the end portion 14*b* of the metal pipe material 14 is excessively larger than the amount of movement of the other end portion, depending on the frictional force between the electrodes 17 and 18 and the metal pipe material 14, a load between the end portion which tries to move due to expansion and the restriction member becomes large. In this case, there is also a possibility that buckling may occur in the metal pipe material 14. Therefore, the control unit 70 may perform control as shown in FIGS. 12A and 12B, FIGS. 13A and 13B, and FIGS. 14A and 14B, in order to suppress such buckling.

The control unit 70 can detects that the amount of movement of one end portion of the end portion 14*a* and the end portion 14*b* of the metal pipe material 14 is larger than the amount of movement of the other end portion. In a case where the control unit 70 has detected that the amount of movement of one end portion is larger than the amount of movement of the other end portion, the control unit 70 moves the restriction member 210 and the restriction member 211 from the other end portion side to the one end portion side.

Figure 12A:
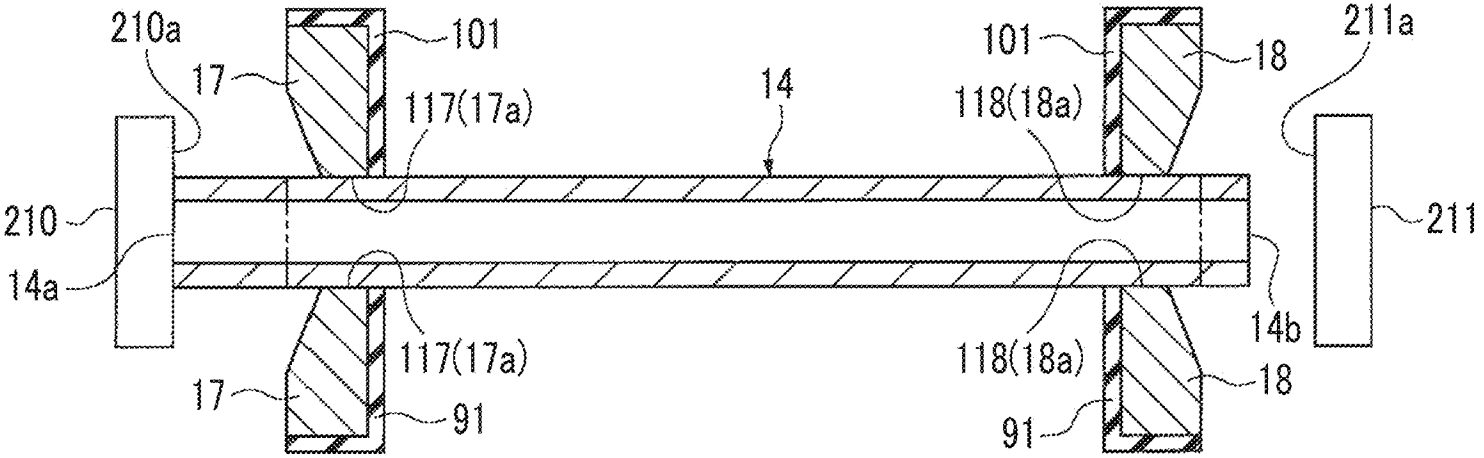
FIGS. 12A and 12B are schematic diagrams showing an operation of a forming apparatus according to a modification example.

For example, as shown in FIG. 12A, in a case where the amount of movement of the end portion 14*a* is excessively larger than the amount of movement of the end portion 14*b*, the end portion 14*a* comes into contact with the restriction member 210 in an early stage in spite of a state where the separation distance between the end portion 14*b* and the restriction member 211 is large. In such a case, the control unit 70 detects that the amount of movement of the end portion 14*a* is excessively larger than the amount of movement of the end portion 14*b*. A detection method in which the control unit 70 detects the above matter is not particularly limited. However, the following methods may be adopted. For example, the control unit 70 may determine whether or not the separation distance between the end portion 14*b* and the restriction member 211 at the time of the contact of the end portion 14*a* exceeds a threshold. Or, the control unit 70 may count a contact time from the point in time of the contact of the end portion 14*a* and determine whether or not the count exceeds a threshold. Alternatively, in a case where a load acting on the restriction member 210 can be detected, the control unit 70 may detect a load that the restriction member 210 receives from the end portion 14*a* due to the expansion of the metal pipe material 14 and determine whether or not the load has exceeded a threshold.

Figure 12B:
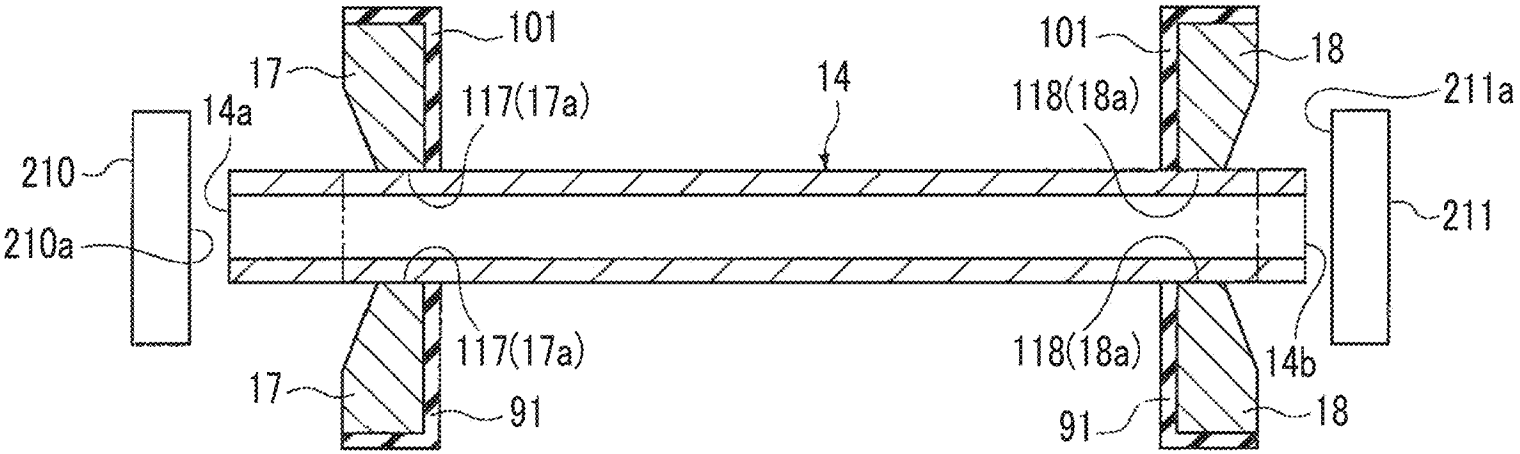

As shown in FIG. 12B, in a case where the control unit 70 has detected that the amount of movement of the end portion 14*a* is larger than the amount of movement of the end portion 14*b*, the control unit 70 moves the restriction member 210 and the restriction member 211 from the end portion 14*b* side to the end portion 14*a* side. At this time, a moving method when the control unit 70 moves the restriction members 210 and 211 is not particularly limited, and various methods may be adopted. For example, the control unit 70 may estimate an expected arrival position of the end portion 14*a* and an expected arrival position of the end portion 14*b* when the metal pipe material 14 has reached a target temperature, and move the restriction members 210 and 211 to the expected arrival positions. In the example shown in FIG. 12B, the restriction members 210 and 211 have moved to the expected arrival positions of the end portions 14*a* and 14*b*. The estimation method is not particularly limited. However, the control unit 70 may perform the estimation, based on the separation distance between the end portion 14*b* and the restriction member 211 at the time of the contact of the end portion 14*a*, a time from the start of the energization heating until the end portion 14*a* comes into contact with the restriction member 210, or the like. The control unit 70 may not perform a direct change from the state shown in FIG. 12A to the state shown in FIG. 12B. For example, the control unit 70 may greatly separate the restriction members 210 and 211 from the end portions 14*a* and 14*b*. once after the end portion 14*a* comes into contact with the restriction member 210. Thereafter, the control unit 70 may move the restriction members 210 and 211 to the expected arrival positions after the calculation is completed.

Figure 13A:
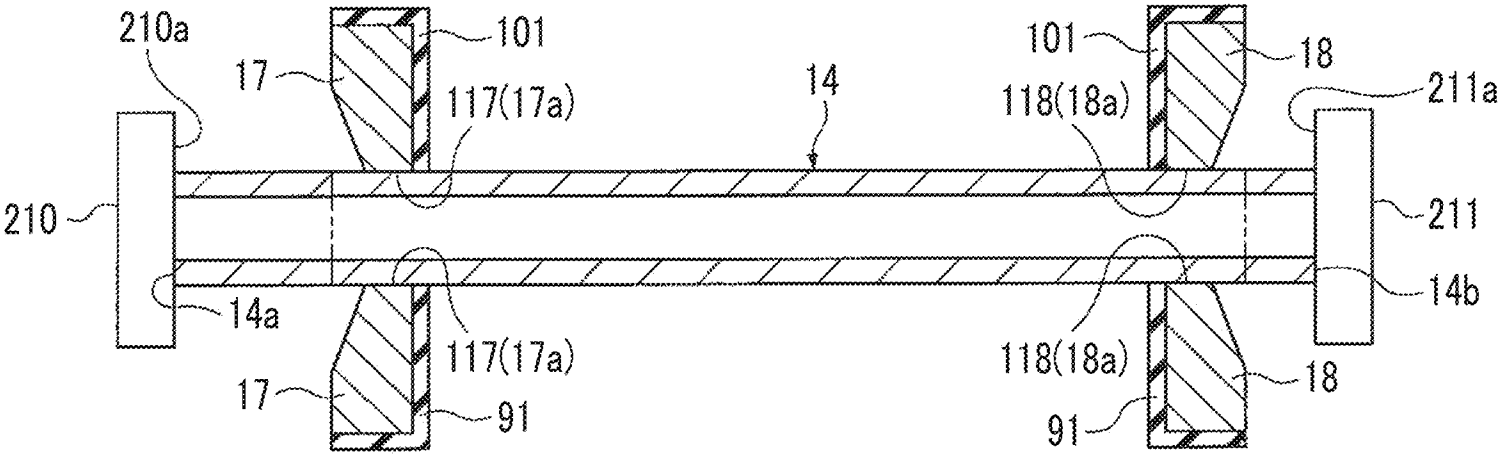
FIGS. 13A and 13B are schematic diagrams showing an operation of a forming apparatus according to a modification example.

Thereafter, the end portions 14*a* and 14*b* further move to the outside in the axial direction and come into contact with the restriction members 210 and 211 when the metal pipe material 14 has reached the target temperature, as shown in FIG. 13A. In this way, the restriction members 210 and 211 can control the amount of expansion such that the metal pipe material 14 does not extend anymore due to expansion. Further, the control unit 70 stops the energization heating by the electrodes 17 and 18 at the timing.

The control unit 70 may not move the restriction members 210 and 211 to the expected arrival positions of the end portions 14*a* and 14*b*, as shown in FIG. 12B. For example, when the end portion 14*a* has come into contact with the restriction member 210, the control unit 70 may move the restriction member 210 so as to be separated from the end portion 14*a* by a certain distance. At the same time, the control unit 70 moves the restriction member 211 so as to approach the end portion 14*b* by the same distance. The control unit 70 may repeat the movement of the restriction members 210 and 211 by such a constant distance until the end portions 14*a* and 14*b* come into contact with the restriction members 210 and 211 substantially at the same time. Alternatively, the control unit 70 may cause the drive unit of the restriction member 210 to be in a free state, and move the restriction member 210 by the amount pushed to the end portion 14*a*. On the other hand, the control unit 70 moves the restriction member 211 so as to approach the end portion 14*b* by the same distance as the distance by which the restriction member 210 is pushed to the end portion 14*a*. The control unit 70 locks the positions of the restriction members 210 and 211 at the point in time when the end portion 14*b* has come into contact with the restriction member 211.

Figure 13B:
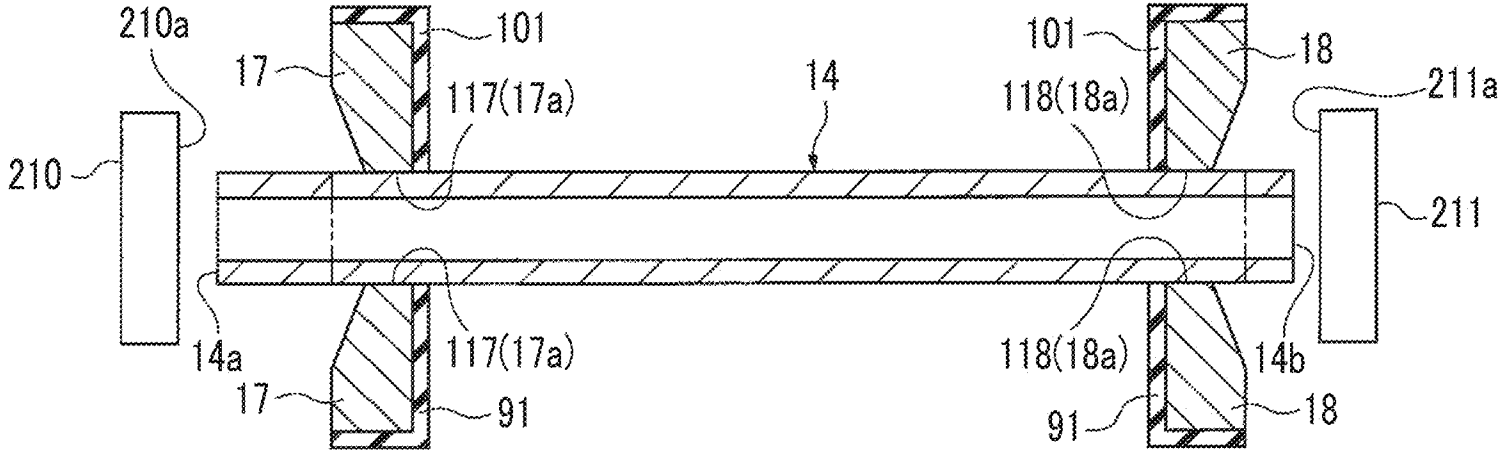
Figure 14A:
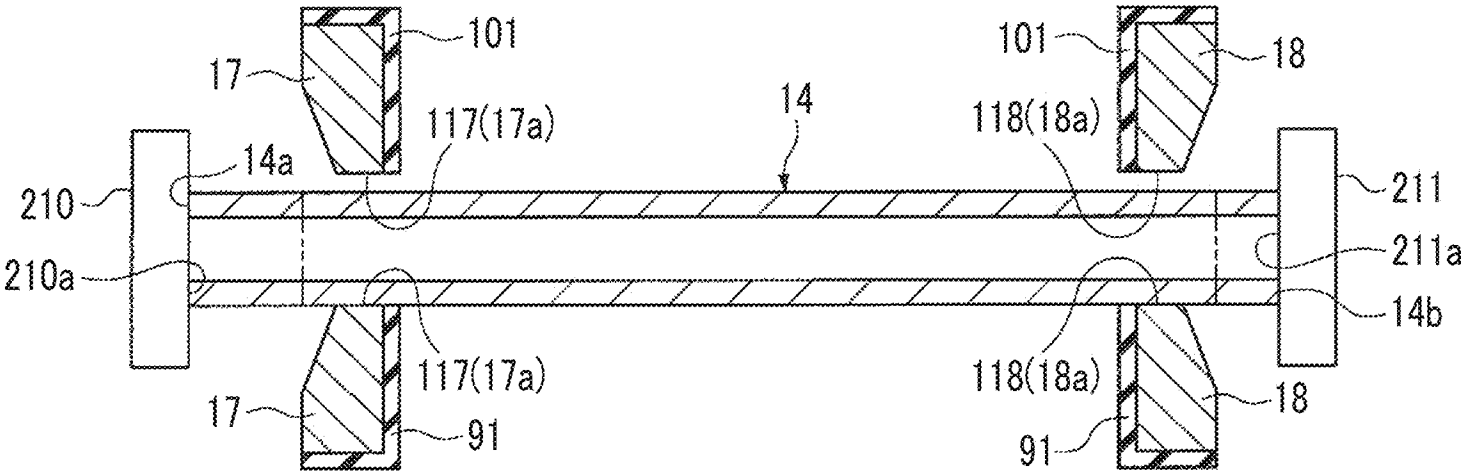
FIGS. 14A and 14B are schematic diagrams showing an operation of a forming apparatus according to a modification example.
Figure 14B:
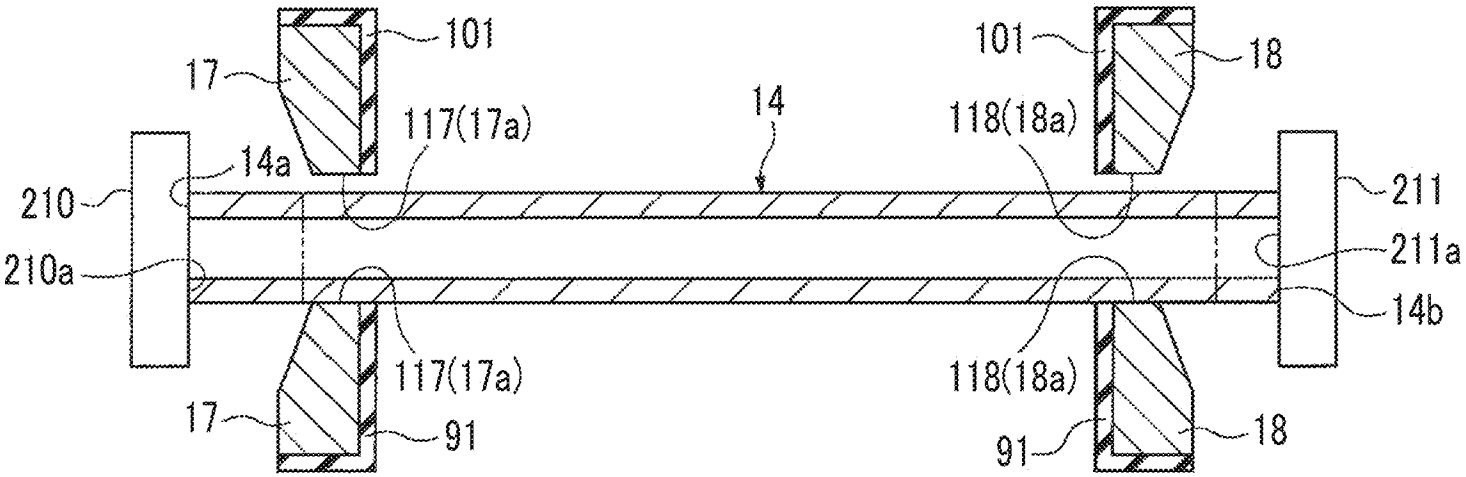

As shown in FIG. 13A, after the metal pipe material 14 reaches the target temperature, the control unit 70 stops the energization heating. Therefore, the metal pipe material 14 is cooled, whereby the metal pipe material 14 contracts from a state where the amount of expansion is the largest (the state of FIG. 13A), as shown in FIG. 13B. Therefore, the end portions 14*a* and 14*b* move inward in the axial direction and move so as to be separated from the restriction members 210 and 211. In this state, since the energization heating has been ended, the electrodes 17 and 18 may not completely clamp the metal pipe material 14. Therefore, as shown in FIG. 14A, the clamping forces of the electrodes 17 and 18 with respect to the metal pipe material 14 are relaxed. The control unit 70 moves the restriction members 210 and 211 inward in the axial direction so as to come into contact with the end portions 14*a* and 14*b*. Then, as shown in FIG. 14B, the control unit 70 performs alignment of the metal pipe material 14 by moving the entire metal pipe material 14 in the axial direction by pushing the end portion 14*a* toward the end portion 14*b* side with the restriction member 210. The control unit 70 performs the alignment of the metal pipe material 14 such that the protrusion amount of the end portion 14*a* from the electrode 17 and the protrusion amount of the end portion 14*b* from the electrode 18 become uniform. In this way, when the metal pipe material 14 is formed in the forming die 13, the metal pipe material 14 can be formed at an optimal position.

As describe above, the forming apparatus according to the modification example further includes the control unit 70 that controls the movements of the restriction member 210 and the restriction member 211 in the axial direction, and in a case where the control unit 70 has detected that the amount of movement of one end portion of the end portion 14*a* and the end portion 14*b* of the metal pipe material 14 is larger than the amount of movement of the other end portion, the control unit 70 moves the restriction member 210 and the restriction member 211 from the other end portion side to the one end portion side. In this case, in a case where the amount of movement of one end portion of the end portion 14*a* and the end portion 14*b* of the metal pipe material 14 becomes too larger than the amount of movement of the other end portion, it is possible to suppress a load which occurs between the metal pipe material 14 which tries to expand and the restriction member from becoming too large.

Further, in the forming apparatus, the control unit 70 may perform the alignment of the metal pipe material 14 in the axial direction by pushing the metal pipe material 14 in the axial direction with at least one of the restriction member 210 and the restriction member 211 after the stop of the heating by the electrode 17 and the electrode 18. In this case, in a case where the amount of movement of one end portion of the end portion 14*a* and the end portion 14*b* of the metal pipe material 14 becomes too larger than the amount of movement of the other end portion, it is possible to align the metal pipe material 14 at a position suitable for forming after the stop of the heating, while suppressing the load acting on the metal pipe material 14 from becoming too large during the heating.

In a case where the forming apparatus includes the imaging unit 203 that detects the amount of movement of the end portion 14*a* and the imaging unit 203 that detects the amount of movement of the end portion 14*b*, the control unit 70 can perform the following control. That is, the control unit 70 can grasp the full length of the metal pipe material 14, based on the amount of movement of the end portion 14*a* and the amount of movement of the end portion 14*b* detected by the imaging units 203. Therefore, the control unit 70 can grasp that the full length of the metal pipe material 14 has become the length when the metal pipe material 14 has reached the target temperature, based on the detection results of the imaging units 203, even in a state where the restriction members 210 and 211 are not in contact with the end portions 14*a* and 14*b*. Therefore, the control unit 70 may stop the energization heating at the timing.

It should be understood that the invention is not limited to the above-described embodiment, but may be modified into various forms on the basis of the spirit of the invention. Additionally, the modifications are included in the scope of the invention.

What is claimed is:

1. A forming apparatus which forms a metal material, comprising:

a forming die for forming the metal material; and a first electrode and a second electrode which hold an outer surface of the metal material at both end sides and heat the metal material by causing an electric current to flow through the metal material, wherein at least one of the first electrode and the second electrode is provided with a movement restriction mechanism which controls a form of expansion of the metal material when the metal material is heated.

2. The forming apparatus according to claim 1, wherein the movement restriction mechanism controls at least one of an expansion direction of the metal material and an amount of movement of an end portion of the metal material, as the form of expansion of the metal material.

3. The forming apparatus according to claim 1, wherein the movement restriction mechanism includes a protrusion portion which is formed on a contact surface of one of the first electrode and the second electrode and protrudes with respect to the metal material.

4. The forming apparatus according to claim 1, wherein the movement restriction mechanism makes a pressing force of a contact surface of one of the first electrode and the second electrode with respect to the metal material larger than a pressing force of a contact surface of the other of the first electrode and the second electrode with respect to the metal material.

5. The forming apparatus according to claim 1, wherein the movement restriction mechanism includes a first restriction member which restricts a movement of the metal material by coming into contact with a first end portion of the metal material on the first electrode side in the axial direction, and a second restriction member which restricts a movement of the metal material by coming into contact with a second end portion of the metal material on the second electrode side in the axial direction.

6. The forming apparatus according to claim 5, further comprising:

a control unit which controls heating by the first electrode and the second electrode, wherein the control unit recognizes that the metal material has reached a target temperature, based on the contact of the first end portion with the first restriction member and the contact of the second end portion with the second restriction member.

7. The forming apparatus according to claim 5, further comprising:

a control unit which controls movements of the first restriction member and the second restriction member in the axial direction, wherein in a case where the control unit has detected that an amount of movement of one end portion of the first end portion and the second end portion of the metal material is larger than an amount of movement of the other end portion, the control unit moves the first restriction member and the second restriction member from the other end portion side to the one end portion side.

8. The forming apparatus according to claim 7, wherein the control unit performs alignment of the metal material in the axial direction by pushing the metal material in the axial direction with at least one of the first restriction member and the second restriction member after the heating by the first electrode and the second electrode is stopped.

9. The forming apparatus according to claim 1, further comprising:

a detection unit which detects an amount of movement of an end portion of the metal material in the axial direction.

10. The forming apparatus according to claim 5, further comprising:

a non-contact type detection unit which detects positions of the first end portion and the second end portion in a non-contact manner to detect the contact of the first end portion with the first restriction member and the contact of the second end portion with the second restriction member.

* * * * *